US007243506B2

(12) United States Patent
Spillner

(10) Patent No.: US 7,243,506 B2
(45) Date of Patent: Jul. 17, 2007

(54) AIR BLANKETED FOOD PREPARATION TABLE

(75) Inventor: Wayne K. Spillner, Kansas City, MO (US)

(73) Assignee: Qualserv Holding Company, North Kansas City, MO (US)

( * ) Notice: Subject to any disclaimer, the term of this patent is extended or adjusted under 35 U.S.C. 154(b) by 131 days.

(21) Appl. No.: 11/075,867

(22) Filed: Mar. 10, 2005

(65) Prior Publication Data

US 2006/0201177 A1 Sep. 14, 2006

(51) Int. Cl.
*A47F 3/04* (2006.01)

(52) U.S. Cl. ..... 62/258; 62/414; 62/419

(58) Field of Classification Search ..... 62/256, 62/258, 407–426
See application file for complete search history.

(56) References Cited

U.S. PATENT DOCUMENTS

| | | | | |
|---|---|---|---|---|
| 4,430,832 | A | 2/1984 | Kaiser et al. | |
| D308,212 | S | 5/1990 | Dallman | |
| D308,527 | S | 6/1990 | Dallman | |
| 5,117,649 | A * | 6/1992 | Mangini et al. | 62/251 |
| 5,168,719 | A * | 12/1992 | Branz et al. | 62/258 |
| D348,367 | S | 7/1994 | Geisen et al. | |
| 5,355,687 | A | 10/1994 | Carpenter et al. | |
| D352,620 | S | 11/1994 | Geisen et al. | |
| D366,578 | S | 1/1996 | Cormican et al. | |
| 5,927,092 | A | 7/1999 | Kushen et al. | |
| 6,089,036 | A * | 7/2000 | Carlson et al. | 62/256 |
| 6,109,051 | A | 8/2000 | Majordy | |
| 6,202,432 | B1 * | 3/2001 | Haasis | 62/258 |
| 6,385,990 | B1 * | 5/2002 | Lee | 62/407 |
| 6,557,366 | B1 | 5/2003 | Spillner | |
| 6,564,569 | B1 * | 5/2003 | Havens | 62/258 |
| 6,640,577 | B2 | 11/2003 | Bauer et al. | |

OTHER PUBLICATIONS

Galley Line, http://www.galleyline.com/modules/refrigerated_salad/index.html, downloaded date Mar. 29, 2004.
Galley Line, http://www.galleyline.com/accessories/access_pg4.html, downloaded date Mar. 29, 2004.
MCCALL, http://mccallrefrigeration.com/Products/Products_Sandwich.asp, Jul. 30, 2004.
MCCALL, http://mccallrefrigeration.com/Products/Products_PizzaPrep.asp, downloaded dated Jul. 30, 2004.

(Continued)

*Primary Examiner*—William E. Tapolcai
(74) *Attorney, Agent, or Firm*—McGuireWoods LLP

(57) ABSTRACT

A method and apparatus is provided to cool and/or protect chilled food in a food pan from warmer ambient air by passing low velocity chilled air from air vents proximate the food pan into and/or over the food pan to form a relatively stable mass of cooled air within the interior of the food pan. The low velocity air may also form a slowly moving barrier of chilled air that hinders warmer ambient air from reaching the food pan. Various embodiments employing numerous arrangements of food pans, cooling system and air ducts configured to direct the chilled air at a low velocity into and/or over the food pans are disclosed.

36 Claims, 19 Drawing Sheets

OTHER PUBLICATIONS

The Delfield Company, Brochure, "Self-Contained Refrigerated Pizza Tables," Model DS18PTB, Nov. 1999.
The Delfield Company, Brochure, "Counter top condiment rail," Model CTP-NB, DSCTPNB, May 1996.
The Delfield Company, Brochure, "Front-Breathing Self-Contained Compact Salad Top Refrigerators," Model 446ON/D446ON, 1999.
NORLAKE, http://www.norlake.com/reach.htm, downloaded Apr. 11, 2004.
Nor-Lake Incorporated, Specification Guide, "Refrigerated Sandwich Units," Feb. 2002.
Nor-Lake Incorporated, Specification Guide, "Refrigerated Preparation Tables," May 2004.
Nor-Lake, Incorporated, Specification Guide, "Refrigerated Preparation Tables," May 2004.
Kairak, "The Kairak Connection," Feb. 2004, Nor-Lake, RR 283/RE324, Data Sheet, Rev Feb. 1999.
KAIRAK, Drop-In Pan Chillers, http://www.kairak.com/product.asp?id=11, downloaded date Jul. 30, 2004.
KAIRAK, Brochure, Models KRP/KRPF-Self Contained Side Mount Compressor, MOdels KRP/KRPF-59S, pp. 36-37, © 2003.
KAIRAK, Brochure, Model# KRD-48S.
MCCALL, Brochure, "Dual Cool Pizza Prep Tables," Sep. 2001.
Model RAMK Reverse Air Flow Kompact, Mullion Reach-In Unit Coller, Feb. 28, 2005.

* cited by examiner

AIR BLANKETED FOOD PREPARATION TABLE

BACKGROUND OF THE INVENTION

1. Field of the Invention

The invention relates generally to cold food preparation tables having open food pans or wells commonly used for pizza, sandwiches, and salad preparation tables (also know as make-tables), and more particularly to an improved make-table that readily complies with model food code standards requiring refrigerated food items to be stored at temperatures of 41° F. or less.

2. Background and Related Art

The restaurant industry utilizes various types of specialized equipment to store food in a cold environment while streamlining food preparation. In particular, food items must be either cold or hot while being stored just prior to serving. Such temperature requirements are based on maintaining the food at a temperature that inhibits bacterial growth as well as preserving the palatability of the food for a certain time period. Many of the safe food storage temperature requirements are based on standards adopted by the National Sanitation Foundation.

For example, a portion of Section 7 of the National Sanitation Foundation (NSF) standard adopted in 1993 requires chilled food to be held under conditions which maintain an internal food temperature of no more than 41° F. for at least 4 hours. This temperature requirement applies regardless of whether the food is held within a closed refrigerator, for example, or in a container open to the room such as for easily accessible ingredients to be used in made-on-demand salads, sandwiches, pizzas, etc.

In addition to holding food at a safe temperature, it is advantageous to hold food in containers configured for easy access by food preparation workers. For example, where food will be used as ingredients for sandwiches to be made on-demand, the food is typically held in chilled pans referred to herein as "food pans," which often are removably recessed into a top surface of a table. The table typically includes a work surface at a height below the food pan tops. Alternatively, the top surface has a raised area, known as "beading," around the opening of the well which supports food pans in a position slightly raised above the surrounding surface. Either way, a work surface lower than the tops of the food pans is useful to minimize accidentally dropping crumbs, cuttings scraps and other waste products from the work surface back into the food pans. This type of table is generally referred to as a "make-table" or "food preparation table" and the portion of the make-table holding the food pans is generally referred to as a "cold rail." Make-tables are commercially available in various configurations that hold a various number of food pans of various dimensions.

The food pans in a make-table are typically open topped pan-shaped containers made from a food compatible material such as stainless steel. The food pans generally have a flat lip around the rim configured to support the food pan while it is positioned in a recess of the cold rail. Additionally, the food pans are configured to be easily placed into and removed from the cold rail from the top surface of the make-table. Simplified food pan replacement facilitates quick replenishment of the food items by lifting out an empty food pan and dropping a full replacement food pan into the opening from above the top surface of the cold rail.

The cold rail of a make-table is generally designed to hold pre-chilled food at a temperature lower than the ambient temperature, rather than do the initial cooling of food.

Additionally, make-tables are generally not used for long term (more than 3 or 4 hours) cold storage of food items. Thus, food pans are typically cooled and stored in a refrigerator then placed in the cold rail immediately before use. Once positioned in the cold rail of a conventional make-table, a food pan is chilled from an exterior surface of the bottom portion of the food pan by an indirect cooling system, such as cooled air circulating within the interior volume of the make-table. Such a cooling configuration leaves the interior of the food pan easily accessible to food workers, as well as providing a simple "plug and play" procedure for swapping a new food pan for an old food pan.

In use, food items such as salads, sandwiches and pizza are prepared on the work surface of the make-table with ingredients being stored in and removed from the food pans. If a high volume of food will be quickly prepared, the tops of the food pans are not covered to facilitate frequent access to the contents by a food worker. Thus, the food stored in a food pan is exposed to room temperature air from above which tends to warm the food beyond compliance with NSF § 7 requirements. When the food pan is empty, the food pan is simply lifted from its hole in the cold rail and a new food pan dropped in its place. Thus, the traditional food pan in the cold rail of a make-table offers easily accessed cold food storage and a simple food preparation system because the food pan is cooled from below while being open at the top and the food pan easily drops into its place on the make-table.

Food service equipment suppliers have proposed numerous approaches and methods to comply with NSF § 7. For instance, one conventional solution to comply with NSF §7 requirements is to place physical covers over the pans to eliminate the impact of ambient air infiltration into the pan. This solution is no longer acceptable to most health inspectors as these covers are frequently left off the food because they make access to the food inconvenient.

Another conventional approach to avoiding unwanted food warming in an open food pan has been to increase the cooling of the lower exterior of the food pan within the make-table cabinet by using refrigerated walls containing a network of refrigerated tubing or coils between the food pans. For example, the "Kairak" cold well uses refrigerated walls between the pans. Each refrigerated wall has a network of refrigerant tubing inside which conducts refrigerant to directly cool the exterior walls of the food pan. The refrigerated walls make an environment conducive to meeting the holding temperature standard of 41° F. or less. This technique is effective but costly and offers a risk of freezing the held product should the refrigerated walls be improperly regulated (a condition that must be field set and verified) and monitored due to varying ambient conditions. Accordingly, cooling the lower exterior of the food pan sufficient to hold the exposed surface of the food in the food pan below the required 41° F. in this system is inefficient and costly, and risks freezing and ruining the held food product should the refrigerated walls be improperly regulated or monitored.

Another approach recesses the rim of the food pans into a well, while wrapping refrigerant tubing above and below the pan rim to provide extra cooling which minimizes the impact of ambient air infiltration. The extra cooling coils increase the expense and complexity of such a make-table, as well as complicating the replacement of food pans due to the need to have a tight fit between the food pan and the extra cooling coils. Thus, this approach produces an expensive to fabricate system that must be field set, calibrated and maintained to achieve the expected results.

Another conventional method of achieving sufficient cooling for a make-table includes adding extra cooling coils proximate the perimeter of the food pans on the top surface of the cold rail. However, such extra cooling coils adds to the expense of the make-table, as well as making it more difficult for food workers to quickly retrieve food items from the interior of the food pans. For example, a "Bloomington rail" recesses the lips of the storage pans into a well while wrapping refrigerant tubing above and below the pan's rim to provide extra cooling that minimizes the impact of ambient air infiltration which would otherwise cause the bulk food temperature to rise above the acceptable holding temperature. The Bloomington rail is also expensive to fabricate and must be field set, calibrated and monitored to achieve the expected results due to variations in ambient air condition from one location to another.

Another conventional method of cooling food in food pans is to direct high velocity chilled air streams at the sides and bottoms or over the open top at just above the tops of the food pans. A face velocity delivered above 100 feet per minute at distance of between ½" and 2" above or at the top of the food pans is considered to be a high velocity stream. For example, high velocity air streams may be directed at the outer or exterior sides and bottoms of the food pans using fans and ducted louvers to enable a "wind chill effect" to locally cool the products and comply with Model Food Code standards. However, though a cost effective design, this system is difficult to regulate, and such systems may or may not deliver the desired cooling results based on the skill and ability of the installer to tune these units properly. Too much or too little air flow, or air at the wrong temperature often results in localized product freezing or the product may quickly rise out of their desired holding temperature range. A more fragile product like sliced tomatoes may readily freeze if too much air blows across its pan walls. To help alleviate this situation slotted inserts are often placed in the pan's bottom to raise the food product off the pan's bottom.

Higher velocity cold air jets are also conventionally utilized to form a protective high velocity barrier of air directed through ducted louvers or a large slot at the top of the held food product. While this is an effective solution, it also may result in prematurely drying out the products (such as shredded cheese) held under this high velocity air barrier. The higher velocity chilled air stream blown across the top of the food in the pan dries the food rendering it less palatable and sometimes unusable, as well as wastefully discharging large amounts of chilled air into the room. Also, properly ducted air flow paths may be costly to fabricate. Thus, the risk of these high velocity air streams includes food deterioration due to drying its surface, both freezing or too high a held food temperature and high manufacturing costs. Despite such drawbacks, this solution is gaining in popularity as it facilitates plug and play holding temperature compliance, and skilled technicians for field calibration are not needed.

In other words, recent studies on food safety and the cause of various food borne illnesses have resulted in more stringent food holding criteria and standards and much activity in developing products to meet these standards. The model food code states that no potentially hazardous refrigerated food items should be stored above 41° F. While this condition is readily attained in closed holding systems, open food wells such as commonly used for pizza, sandwich and salad preparation tables do not easily meet this performance standard unless special design adjustments or adaptations are provided. Thus, there is a need for an improved apparatus and method for storing food in open containers at sanitary temperatures that can comply with, and preferably exceed NSF §7 standards in a cost efficient manner without risk of freezing or drying out food and without using overly complicated equipment or requiring field system calibration, while at the same time retaining the advantages of a "plug and play" design.

SUMMARY OF THE INVENTION

The invention meets the foregoing need and avoids the drawbacks and disadvantages of the prior art by keeping food cool by covering the food with a low velocity blanket of chilled air and/or a barrier of low velocity chilled air slowly moving over the top of food pans. In particular, make-tables made in accordance with the principles of the invention chill food or maintain food at a low temperature in a unique and commercially superior manner when contrasted with the more conventional methods used by other food service equipment suppliers. Embodiments of the invention include the use of low velocity air streams created using a cooling system that may have a top discharge fan, evaporator coils and an array of fixed baffles and vents to direct the air current in a way that "plug and play" results are achieved for a family of open food wells or rails. Products made in accordance with the invention may be evaluated in a lab setting to establish the correct baffle positioning for each well style before they are sold or used in the field.

The low velocity air streams of the invention provide a protective insulating boundary layer of air at the product surface rather than moving large amounts of chilled air, which causes the "relative drying" of the surface that typical higher velocity designs experience. As cool air is heavier than warmer room air, the cold air will naturally fall into the food pan and gently buffer the existing boundary layer of air if the velocity of the cold air blanket is controlled below 100 feet per minute ("ft/min"), and preferably within a range of between about 8 and about 75 ft/min at the vent face at a distance between approximately ½ to 2" above the food pans. The air streams are directed over the food pans, air is generally not blown down at the food. This wafting of the more dense or heavier cool air over the held food product shields the food product from the harmful, hot humid room air for distances typically ranging between about 4" and 24" horizontally from the vent faces depending on how the particular systems are configured.

Experimentation has shown that low velocity chilled air may provide an insulating boundary layer of cooler air (40° F. to 55° F.) immediately above the held food product surfaces. This boundary layer retards the negative impact of infiltrating warm air on the bulk food temperature so such a boundary layer will readily satisfy the NSF 7 target of 41° F. or less for the required 4 hour period after food is placed in the open well. Food shelf life is extended without the risk of localized freezing or drying of the top surface of the held food product. Embodiments of the invention work equally well with either plastic or metal food containers or pans.

Because standard commercial components are used with minimal modification (for example, the addition of adjustable air baffles and air vents to pre-existing make-table designs), manufacturing costs are not adversely impacted and the open well "air blanketed" or "air quilt" work stations of the invention may be competitively priced. Experimentation has shown that better results can be obtained when a make-table made in accordance with the principles of the invention is operated with all pans in place and subjected to little or no local air currents (such as fans or ventilation supply flow) directed at the food pans. Otherwise, the insulating layer may be disrupted which may adversely impact performance. Standard regulation of the base storage temperature using a chilled-air source, such as, for example, a top discharge fan coil evaporator with one change-continuous operation of the fan, which runs even if freon or other refrigerant is not flowing as the interior desired temperature is satisfied, allows make-tables of the invention to meet the expected performance standards. Typically the wells should be emptied and night covers used when the work station is not staffed to maximize the system thermodynamic efficiency and reduce energy usage.

According to one aspect of the invention, a refrigerated make-table, includes at least one food pan having an opening in fluid communication with an interior space in the food pan, an air duct in fluid communication with the opening in the at least one food pan, and a cooling system including a chilled air source conducting chilled air into air duct and to the opening of the at least one food pan at a low velocity sufficient to form an air blanket isolating the at least one food pan from ambient air and maintaining the interior of the at least one food pan at a temperature range between approximately 35° F. and approximately 41° F.

To achieve the maximum benefits of the invention, the velocity should be less than about 100 feet per minute and preferably, in a range of approximately 8 feet per minute to approximately 75 feet per minute. The air blanket may remain within the interior space of the at least one food pan, and/or form a barrier of low velocity chilled air moving over the opening of the at least one food pan, to hinder warmer ambient air from entering into the opening. The opening in the at least one food pan may be an opening in a top portion of the at least one food pan. The chilled air source may include at least one evaporative refrigeration coil and a fan directing chilled air from and around the coil into the air duct.

The cooling system may be disposed within the make-table, and may include an adjustable control element configured to divide the chilled air from the source into a plurality of streams, with one of the streams being conducted to directly cool the at least one food pan and another of the streams being conducted into the air duct. The adjustable control element may include, a plurality of baffles, at least one of which may be fixed in any number of positions. The control element may control the direction of chilled air conducted from the air duct to flow over the top of the at least one food pan. The control element may be an air header assembly having a plurality of apertures, and the apertures may be arranged in staggered rows.

The air duct may be defined by the space between the at least one food pan and an internal wall of the make-table, and may be formed without any conduits isolated from the interior of the make-table. Optional cooling devices located adjacent to the air duct or the at least one food pan, may also be provided. The make-table may include a first raised rail and the air duct may be located at least partially in the first rail, which typically is in a rear portion of the table.

A second raised rail including an auxiliary cooling system for cooling the at least one food pan may be provided and the first and second raised rails may be disposed at opposite edges of the at least one food pan.

The food pans typically include multiple pans or rows of food pans, which may be disposed to receive chilled air from the air duct. At least one row of the multiple rows of food pans may be positioned at a different level than another row of food pans, and the air duct may include a first and a second spaced air duct, with each duct conducting low velocity chilled air into at least one row of the multiple rows of food pans. The second air duct may direct chilled air at low velocity in a direction substantially opposite to the direction air emanates from the first air duct, or the first and second air ducts may have vents facing in substantially similar directions. Finally, a raised barrier maybe disposed in a position substantially surrounding the at least one food pan to help isolate low velocity chilled air directed thereto from ambient air.

In another aspect of the invention, a method of maintaining or decreasing the temperature of food in a food pan of a refrigerated make-table is provided, including: i) placing the food pan at least partially within a food pan well in the make-table; ii) directing chilled air to the food pan; and iii) controlling the velocity of the chilled air to permit the chilled air to create a protective boundary layer of chilled air disposed above the food in the food pan, thereby providing an air blanket insulating the food pan from ambient air and maintaining an interior temperature of the food pan at a temperature of about 35° F. to about 41° F. The velocity controlling step may include directing chilled air over the food pan at a velocity of less than about 100 feet per minute, and preferably, in a range of approximately 8 feet per minute to approximately 75 feet per minute.

The air blanket created by the velocity controlling step may set up an insulating boundary layer of colder heavier air which may remain within the food pan and/or may form a barrier comprising low velocity chilled air moving over the food pan to isolate the food pan from the warmer, more humid ambient air. The method also may include cooling the exterior of the food pan. Indeed the step of directing chilled air to the food pan may include dividing the chilled air into a series of streams, with one of the streams being directed to the interior of the food pan and the other to the exterior of the food pan. The direction of at least one of the chilled air streams may be adjustably controlled. If the food pan includes at least two rows of food pans, the chilled air may be divided into at least three streams, with first one of the streams being directed into a first food pan, a second one of the streams being directed into a second food pan, and a third one of the streams being directed towards the exterior of at least one of the first and second food pans. The chilled air may be divided into two low velocity streams generally directed towards each other or generally directed in substantially similar directions.

In yet another aspect of the invention, a refrigerated make-table may include means for containing food, means for supporting the food containing means, and means for cooling food in the food containing means. The cooling means may include a substantially stable layer of chilled air disposed at least partially within the food pan and/or a barrier of low velocity chilled air moving over the containing means that hinders warmer ambient air from entering the containing means.

Additional features, advantages and embodiments of the invention may be set forth in the following detailed description, drawings, and claims, including methods of using the invention to keep already chilled food cool and to chill food. Although numerous implementations and examples of the invention are set forth in the patent, including in this "Summary of the Invention" section, the examples and implementations are not intended to limit the scope of the invention.

BRIEF DESCRIPTION OF THE DRAWINGS

The accompanying drawings, which are included to provide a further understanding of the invention and are incorporated in and constitute a part of this specification, illustrate preferred embodiments of the invention and together with the detailed description serve to explain the principles of the invention. In the drawings.

DETAILED DESCRIPTION OF PREFERRED EMBODIMENTS OF THE INVENTION

Figure 1:
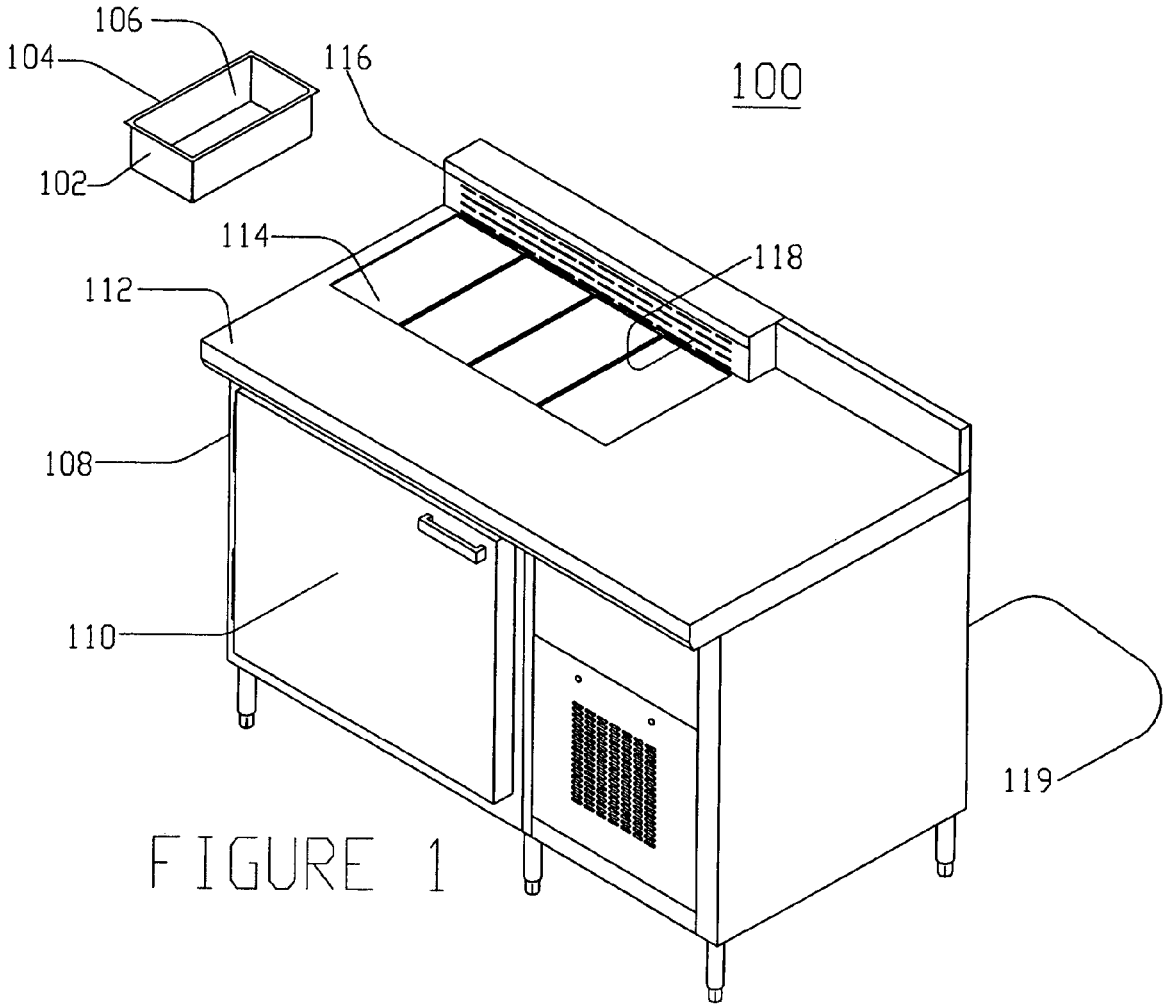
FIG. 1 is an elevated front perspective view of a first embodiment of an air blanketed food preparation table constructed according to the principles of the invention containing four food trays arranged in a single row, single step configuration.

The figures herein illustrate various embodiments of a device for holding pre-chilled food in a food-preparation table at cooled temperatures. Embodiments of the invention provide a blanket or stable layer of chilled air to envelope or surround food while the food is held in a food pan. The stable chilled air blanket or air quilt allows the pre-chilled food to be held in the food pan while also providing easy access for food preparation and shielding or protecting the food from warmer and/or moister ambient or room temperature air. Additionally, a shield of chilled air in the form of a stream of low velocity cooled or chilled air directed over the top of food pans may also protect the contents of the food pans.

The invention may also allow the food pans to be quickly and easily replaced during operation of the food preparation table. Accordingly, both the ease of access to the contents of the food pans and the ease of replacement of food pans in the food preparation table maximize the efficiency of food preparation and speeds food service. The food preparation table of the invention allows food to be held under sanitary conditions while maintaining ease of access and the palatability of the food.

Various embodiments of the food preparation table are configured to allow chilled air within the interior region of the food preparation table to circulate around the exterior surfaces of a food pan inserted into a food pan well which is typically disposed in an upper surface of the food preparation table. Additionally, internal ducting, venting or baffling within the food preparation table allows a portion of the chilled air circulating within the food preparation table to be vented or directed at a low velocity over and/or into a food pan, which is typically any velocity equal to or below 100 ft/min and preferably between about 8 ft/min and 75 ft/min at the vent face at a distance between about ½ to 2" above the food pans. Accordingly, chilled air is allowed to move at a low velocity above and/or into a lower portion of the food pan, and thus protect and/or fill the food pan with chilled air, thereby covering any food positioned in the food pan with a blanket of chilled air.

Because the chilled air moves at a low velocity, a portion of the "denser" chilled air may "pool" or "sink" to the bottom of the food pan and form a substantially stable cold air mass therein. As the chilled blanket of air is disturbed when the contents of the food pan are removed during food preparation, more chilled air may slowly find its way into the interior of the food pan thereby replacing any chilled air which may be lost from the interior of the food pan. Additionally, as the chilled air blanket in the food pan is warmed by coming in contact with warmer ambient air or the hands of food preparers, etc., the warmed air loses density and rises to the top of the food pan to be replaced by new chilled air slowly moving from the vents of the food preparation table and sinking into the bottom of the food pan.

Accordingly, the air blanketed food preparation table of the invention may allow for a relatively slow and continuous replacement of cooling air as needed within the food pan such that the lower portion of the food pan will substantially always have disposed therein air chilled at a pre-determined temperature. Additionally, a layer of low velocity chilled air may be directed over the top of the pan to form a shield or barrier blocking or otherwise preventing warm air from entering the interior of the pan. It should be noted that while the air blanket is effective in maintaining an appropriate bulk food temperature (less than 41 F for 4 hours or longer), the low velocity air stream does not tend to dry out the held food product thereby avoiding a rapid deterioration of food quality, flavor and/or texture and also avoids the risk of freezing the product caused by subjecting the food pan side walls to excessively cold temperature gradients.

FIGS. 1 through 5 illustrate a first example of an air blanketed food preparation table of the invention. Referring to FIG. 1, a perspective view of an air blanketed food preparation table 100 with one of its food pans 102 is shown. The food pan 102 has a rim 104 around its upper portion. The food pan 102 also has an interior 106. The food preparation table 100 includes an exterior cabinet 108. The exterior cabinet 108 includes a top surface 112, a front 110 and a rear 119 and two sides. Arranged within the top surface 112 of the air blanketed food preparation table 100 are four food pan wells 114 disposed in a single row. The air blanketed food preparation table 100 also includes an air header assembly 116 positioned towards the rear of the top surface 112 on a raised rail. The air header assembly 116 forms part of an air duct and includes slotted air vents 118 (also referred to as "slots" or "vents"), which communicate with an interior region of the cabinet 108 that includes a source of chilled air, as described subsequently.

Although the air blanketed food preparation table 100 illustrated in FIG. 1 shows four food pans 102, an air blanketed food preparation table of the invention may have virtually any number of food pans and fall within the scope of the invention. Additionally, the food pans 102 may be arranged in virtually any configuration as long each food pan 102 is sufficiently close to an air vent 118 to receive adequate chilled air to keep the contents of the food pan 102 cooled as required. Thus, food pans 102 may be arranged in single row, double rows, triple rows, etc. Some examples of such possible arrangements are shown and described herein. Additionally, the food pans 102 may be arranged relatively level on a horizontal plane with one another or may be on different levels, i.e., stepped in height from one to the next, etc. Table 100 is an example of a single row, single step embodiment as the trays are arranged in one row at the same height.

For multiple rows of food pans, more than one row may have an adjacent air duct with air vents for directing air to one or more rows of pans. Where there is more than one air duct with air vents, some of the air vents may point in the same direction or in opposite directions to one another, and some of the air vents may be located at different heights relative to one another. Again, examples of such arrangements are described herein. Furthermore, some or all the food pans may have air vents in the walls of the food pan itself, where the air vents receive chilled air either directly or indirectly through an air duct communicating with the interior of the table. Examples of some of the various configurations and embodiments of the air duct and vent configurations also are disclosed herein.

The food pan wells 114 are configured to receive and support food pans 102 therein. Accordingly the food pan 102 may be placed within the food pan wells 114 with the rim 104 of the food pan 102 resting on the surface 112 of the air blanketed food preparation table 100. This is shown best in cross sectional views, such as FIGS. 4, 6, 6A and 6C. Thus, when the food pan 102 is positioned in the food pan well 114, the top surface or opening into the interior 106 of the food pan 102 may be flush or substantially flush with the upper surface 112 of the air blanketed food preparation table 100. The food preparation table 100 may also be configured so that one or more food pans 102 are recessed below the surface 112.

Figure 2:
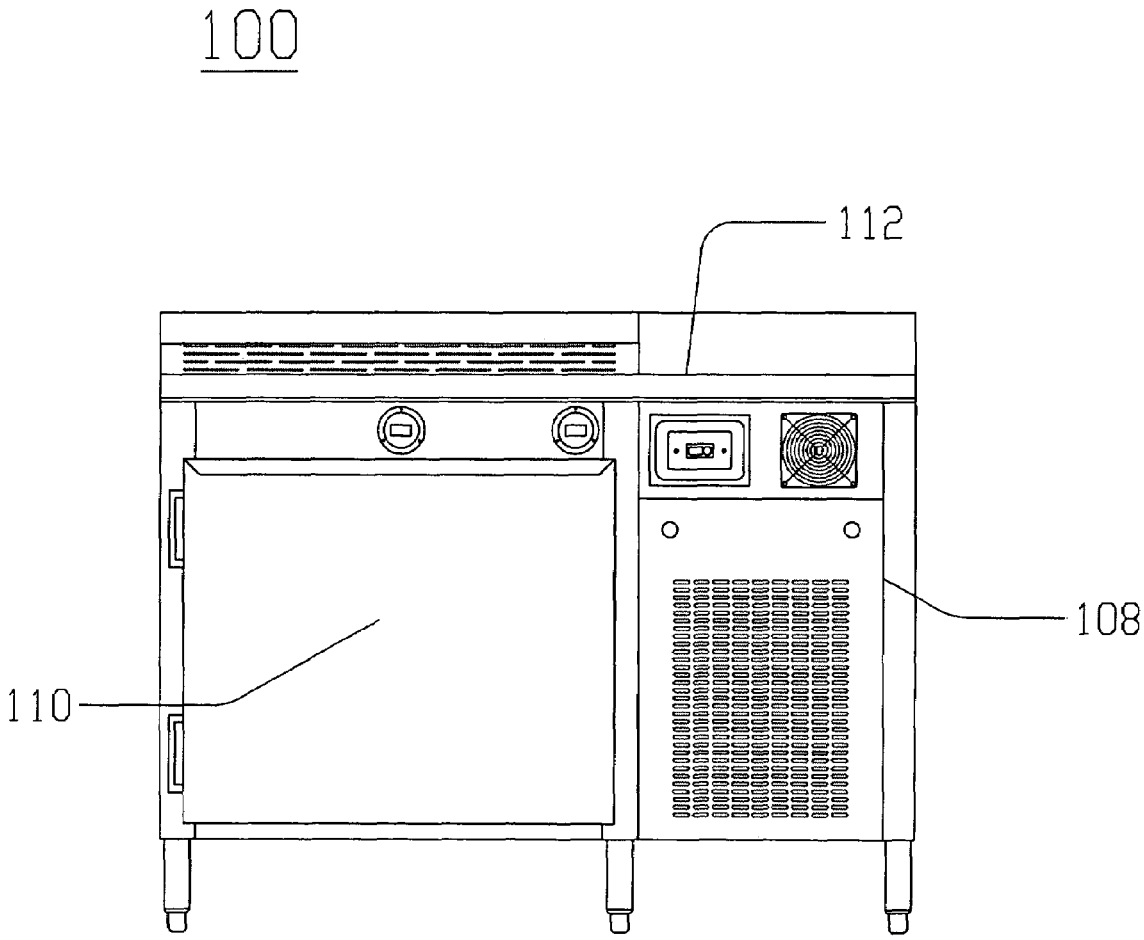
FIG. 2 is a front view of the table of FIG. 1.

FIG. 2 is a front view of the table of FIG. 1. As shown in FIG. 2, the exterior cabinet 108 has a front 110 and a top surface 112. The front 110 may include various controls for the cooling system, as well as a door for access into the interior of the air blanketed food preparation table 100. The cooling system controls may include a temperature selector as well as an air velocity selector.

Figure 3:
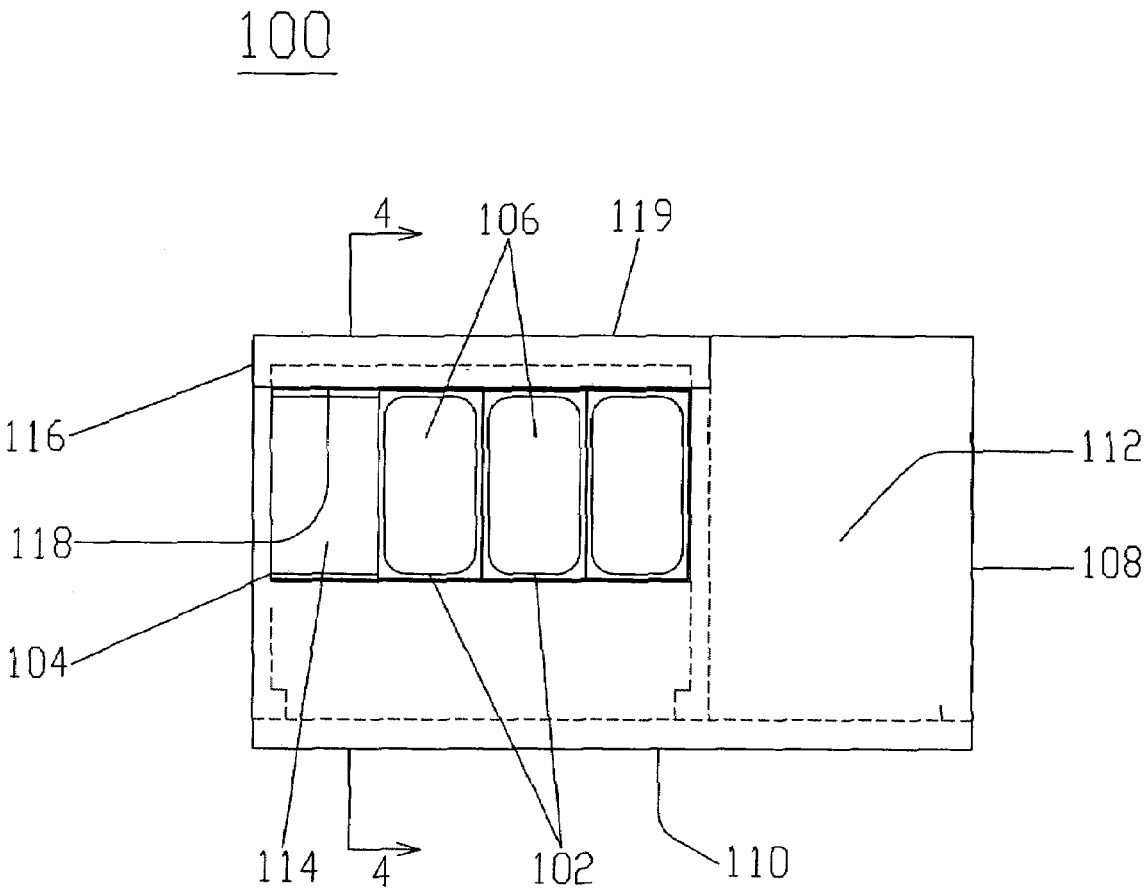
FIG. 3 is a top, plan view of the table of FIG. 1.

FIG. 3 is a top view of the table of FIG. 1. As shown in FIG. 3, the exterior cabinet 108 of the air blanketed food preparation table 100 has the front 110 and the rear 119 arranged substantially parallel to one another. The top surface 112 typically is perpendicular to the front 110 and the rear 119 and connects therebetween. As shown, the top surface 112 of the blanketed food preparation table 100 may have only a portion of it occupied by food pan wells 114 and corresponding food pans 102, and remaining portion(s) may be used as a work surface. It should be noted that each food pan well 114 should be occupied with a food pan 102 or otherwise covered in order for the chilled air to flow properly within the interior of the exterior cabinet 108 and exit the vents 118 in a manner sufficient for keeping the contents of the food pans 102 cooled.

Figure 4:
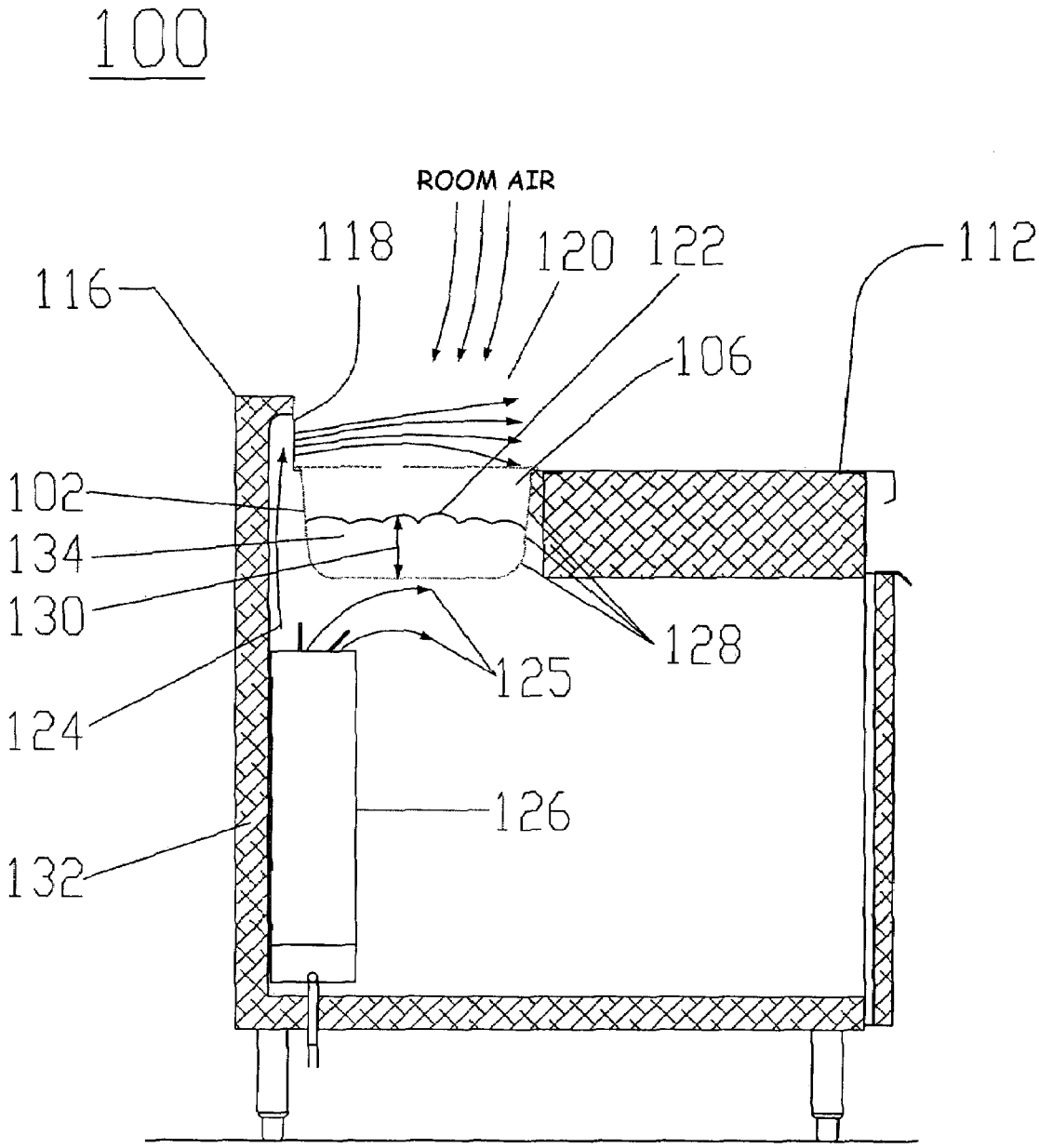
FIG. 4 is a cross sectional view of the table of FIG. 1 taken along lines 4—4 of FIG. 3.

FIG. 4 is a cross sectional view of the table 100 taken along lines 4—4 of FIG. 3. As shown in FIG. 4, an air cooling system 126 is located within an interior of the food preparation table 100. A cooling unit 126 such as, for example, a top discharge evaporative cooling unit, having an evaporative coil and variable speed fan, directs chilled air along flow paths 124 and 125 through the interior of the food preparation table 100 around the sides and bottoms of the food pan's exterior surface 128, as shown.

Figures 7A, 7B:
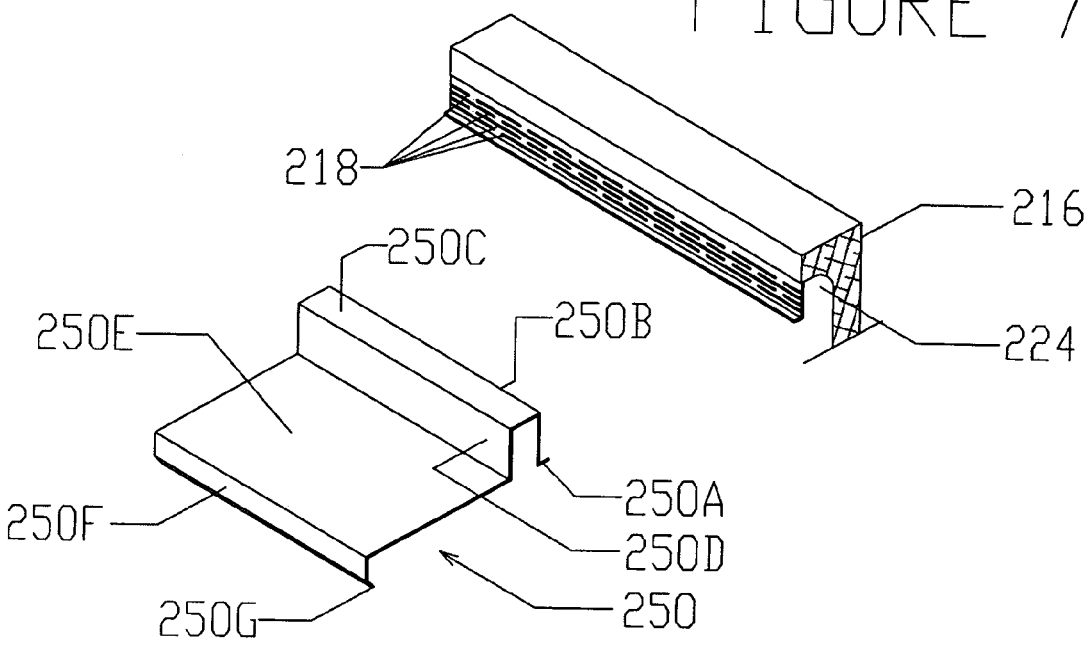
FIG. 7A is an elevated front perspective view of the air slot header assembly which may be used in the table of FIG. 1.
FIG. 7B is a partial, elevated front perspective view of the front tray support and integrated work surface used in the table of FIG. 1.

For example, the selected top discharge fan evaporation coil may be a commercially available unit that enables vents in the air header assembly discussed in relation to FIGS. 1 and 7 to be grouped for covering a section or segment of pans 20" to 24" along the length of the air header assembly. Thus, in the embodiment of FIG. 1, one such evaporator coil can serve all four of the illustrated food pans. As the number of sections of food pans is increased, additional coils may be added evenly spaced within the cabinet relative to one another to supply additional cooling air for the added sections of food pans. For example, each section of food pans may have a corresponding cooling coil located along the back side of the cabinet and underneath the section of air header assembly which supplies cool air to the food pans. Where each section of food pans is about 24" long, each corresponding top discharge fan evaporation coil may be about 20" long. The evaporator coils may be connected to a common refrigerator compressor in compressor housing at one end of the cabinet 108.

Figures 6, 6A, 6B, 6C:
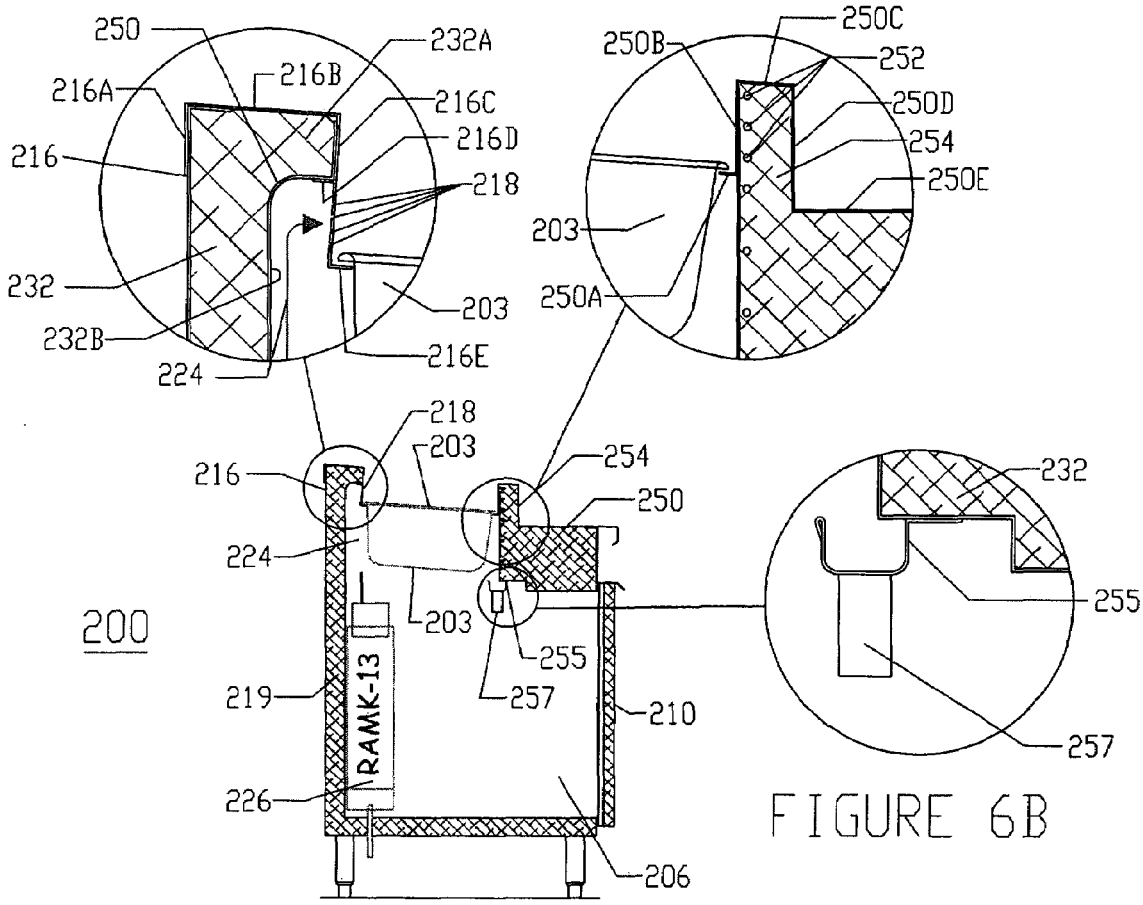
FIG. 6 is a cross sectional view of a second embodiment of an air blanketed food preparation table constructed according to the principles of the invention in which the food pans are recessed in wells between front and rear rails.
FIG. 6A is an enlarged cross sectional view of the upper back rail portion of the table of FIG. 6 illustrating the air duct formed by the table, air slot header assembly and food trays of the invention.
FIG. 6B is an enlarged, cross sectional view of the bottom of the front rail portion of FIG. 6 showing a drain constructed in accordance with the invention.
FIG. 6C is an enlarged, cross sectional view of the top of the front rail portion of FIG. 6 showing a front tray support and optional refrigeration coils of the invention.
Figure 15:
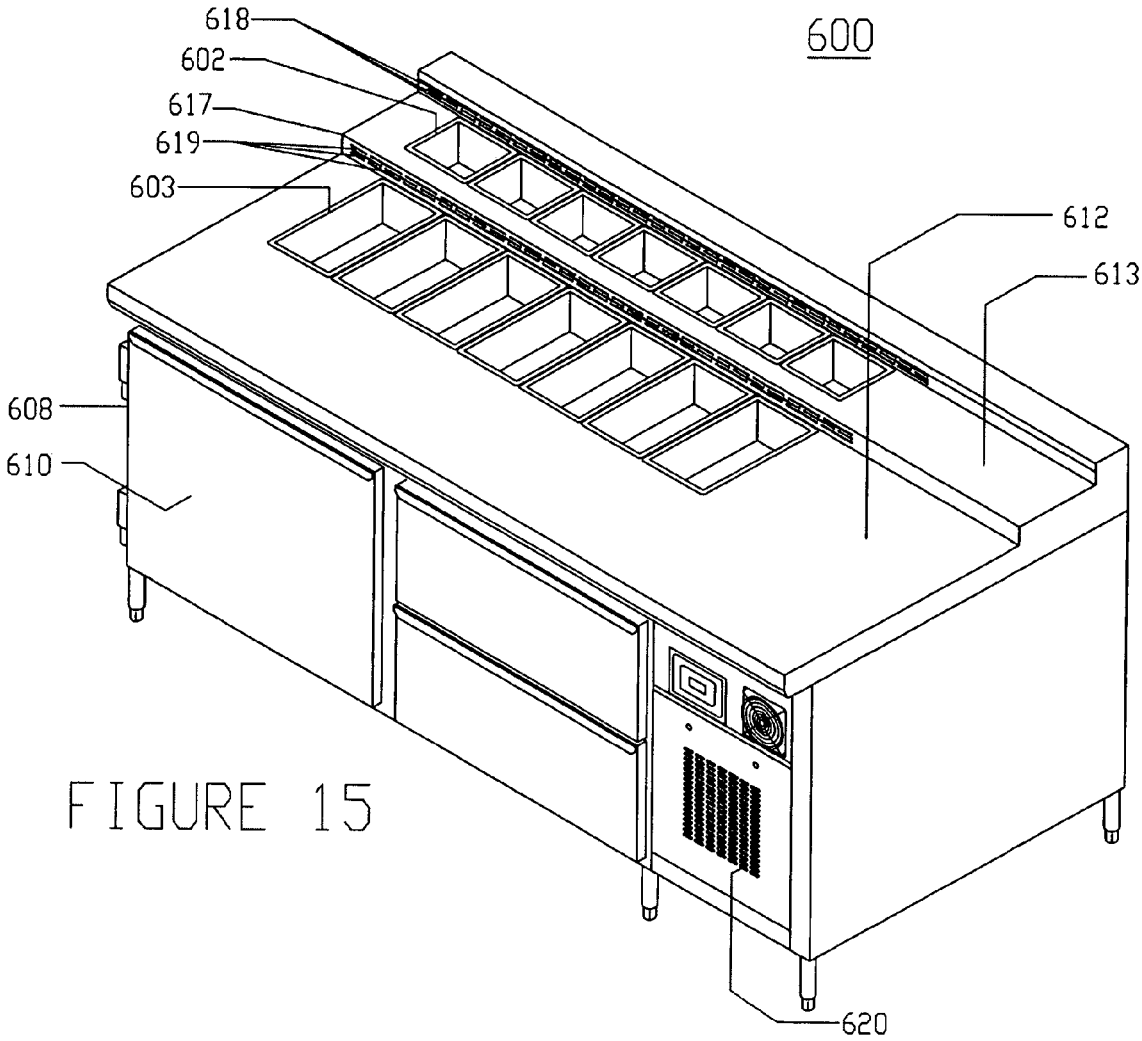
FIG. 15 is an elevated front perspective of a sixth embodiment of an air blanketed food preparation table constructed according to the principles of the invention in which the two rows food trays are arranged in a double step configuration.

For each 24" section of food pans, about 1300 BTU/hr of cooling may be selected with from about 8% to about 25% of the air from the evaporator to be discharged through the vents of the air header assembly over the pans. A distance of up to about 15" away from the slots in the air header assembly may be cooled with such an arrangement. An additional cooling source may be included to cool distances larger than 15" from the air header assembly. Such additional cooling may take the form of cooling coils in the rail and recessing the food pans (as shown in FIGS. 6 and 6C, for example), as well as a second air header assembly supplementing the first air header assembly (as shown in FIG. 15, for example). Additionally, the cooling system may be configured to deliver air at a slot velocity of about 8 to about 100 ft/min based on whether 3, 4 or 5 rows of slots are used in the air header assembly. Also, the number of rows of slots in the air header assembly may be based on whether the food pans are level or recessed relative to the top surface of the food table.

Cooling units suitable for use with the invention include any system known in the art including commercially available systems, such as, for example, a RAMK-13 coil available from the Heatcraft company, Bohn or Chandler Divisions. Other cooling units, such as an equivalent top discharge reversed coil including, for example, a top discharge Russell coil or other commercial coil manufacturer's top discharge fan evaporator coil may also be used.

Thus air from the air cooling system 126 includes air flowing and circulating within the interior of the food preparation table 100 along interior air flow path 124 to the air header assembly 116 and along air flow paths 125 directed toward the exterior surface 128 of the food pans 102. The flow path may be created by baffles on top of the cooling unit, as described subsequently. Food in the pans 102 may be indirectly cooled via heat conduction through exterior surface 128 of the food pans 102 to chilled air flowing along paths 125.

A portion of air flowing from the air cooling unit 126 via path 124 may enter the air header assembly 116 located in an upper region of the food preparation table 100 to more directly cool food in pans 102 from their open tops. More specifically, chilled air within the air header assembly 116 is directed by a duct formed between the sides of food pans 102 and the interior walls of the cabinet, as described in connection with FIG. 6A, to exit at a low velocity out of the air header assembly 116 through slotted air vents 118. Chilled air leaving the air vents 118 follows exterior air flow paths 120 above the top surface 112 of the food preparation table 100 and food pans 102 and some of the chilled air may fall into the interior 106 of food pans 102. As chilled air is denser than ambient air, it will gently fall into the interior 106 of the food pan 102 forming an air blanket 134 therein having a height of 130. The air flow may be controlled such that top surface 122 of the air blanket 134 lies within the food pan 102 at or slightly below the food pan rim 104. As chilled air continues to flow from the air vent 118 into the interior 106 of the food pan 102 displacing any warm air which may reside therein, some chilled air may eventually overflow the food pan 102 and flow across the top surface 112 of the food preparation table 100 at low velocity and spill over its sides.

In addition to displacing warm air from the interior 106 of the food pan 102, chilled air exiting the vent 118 may block warmer, ambient air from the room from entering the food pan 102 by forming a barrier 120 of slowly moving chilled air above the top of the food pan 102. The momentum of the chilled air flowing across the top of the food pan 102 forms a barrier that impedes the flow of warm room air into the food pan 102. By reducing the amount of ambient air which may enter the food pan 102, the low velocity flow of chilled air across the top of the food pan 102 allows food, which typically has been previously chilled, to remain cool for a longer period of time. In accordance with the principles of the invention, the slow flow of chilled air across the top of the food pans may hold chilled food at a cool temperature through at least one of two mechanisms: 1) surrounding the chilled food in the food pans with a blanket of chilled air; and 2) restricting the amount of warm air that may flow into the open top of the food pans.

As can be seen in FIGS. 1–4, chilled air from a single source, which may reside within the food preparation table, or from an external chilled air source, flows through the interior of the food preparation table indirectly chilling the contents of the food pan through conduction, as well as flowing into and/or above the food pan cooling the food therein directly. The chilled air may also serve to block warm air from entering the food pan.

In some applications, it may be preferable for the table 100 to include thermal insulation 132 shown schematically in FIG. 4 in at least some of the walls of the exterior cabinet 108. The thermal insulation 132 may serve to increase the efficiency of the cooling unit 126 by reducing the negative effects of a warm environment on the cooled air produced by the cooling unit 126 while within the interior of the blanketed food preparation table 100. Additionally, the thermal insulation 132 may provide acoustic insulation to reduce or prevent noise from the cooling system within the exterior cabinet from reaching the surrounding environment.

Figure 5:
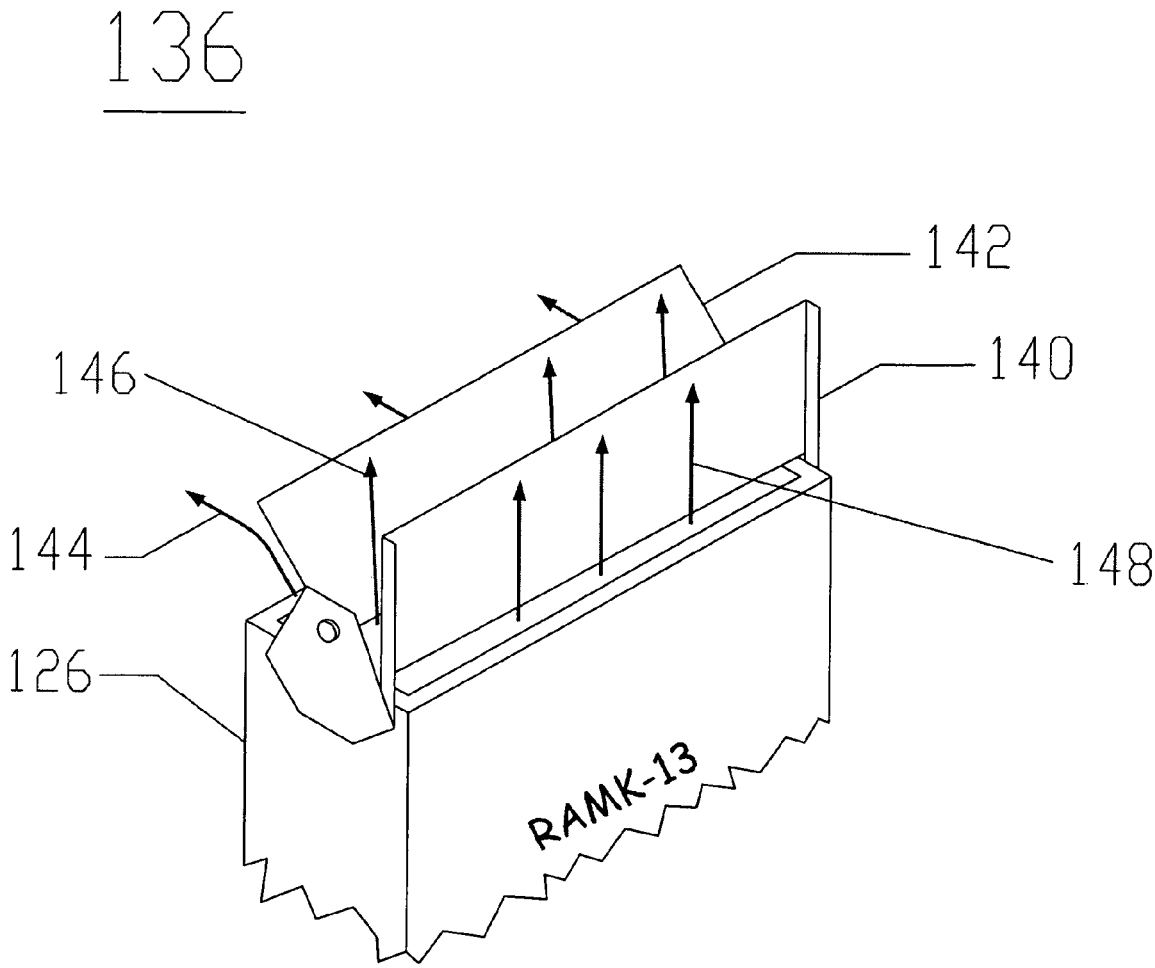
FIG. 5 is an elevated view of a compressor unit and adjustable baffle that may be used in the table of FIG. 1.

Referring to FIG. 5, the top of an example of a cooling unit 126 includes baffles to direct chilled air from the cooling unit 126 along various flow paths within the food preparation table at 100. In particular, the cooling unit 126 has a first baffle 140 and a second baffle 142. In this example, the first baffle 140 is rigidly fixed on a top of the cooling unit 126, and the second baffle 142 is pivotably mounted on a top of the cooling system 126 to be positionable in a number of adjustable positions. Accordingly, the first baffle 140 and second baffle 142 define a first air path 148, a second air path 146, and a third air path 144. Because the second baffle 142 is pivotable, the third air path 144 and second air path 146 can be adjusted. As such, the first baffle 140 and second baffle 142 work in cooperation with one another to direct air to all portions of the interior of the food preparation table 100 as needed. In particular, air from flow paths 146 and 148 may be directed to air header assembly 116 via path 124, while air from path 144 may be directed to the bottom of the food pans via paths 125. By adjusting the second baffle 142, the amount of air directed upwardly via path 146 or outwardly via path 144 may be adjusted. Typically, these adjustments would initially be made at the factory, but could be made on site by qualified technicians as necessary. When factory set and tested, the make-table can use a locked or fixed baffle arrangement to prevent misadjustment by an unqualified technician.

Referring to FIGS. 6, 6A, 6B, and 6C, a cross section of a second embodiment of a food preparation table 200 of the invention and enlarged views thereof are shown that illustrate some of the details of the air header assembly and the support of the food pans of the invention, which may be applicable to other embodiments illustrated herein. It should be noted that this version recesses the food pan in the open well. The food preparation table 200 is generally similar to the first embodiment 100 except for the food pans 203 being downwardly tilted toward the front of the table and including an optional front cold rail 254.

Referring to FIG. 6, the food preparation table 200 has a front 210 and a back 219. An interior 206 of the food preparation table 200 includes an air cooling unit 226, which may be, for example, a RAMK-13 cooling coil. A food pan 203 is located near the top of the food preparation table 200 between a front cold rail 254 and air vents 218 of air header assembly 216 in the rear. A drip through pan 255 and drain 257 for draining during a defrost mode is also shown. As shown, the food pan 203 may be slightly tilted in a forward direction. It should be noted that the food pans of the invention may also be level or tilted in virtually any direction by any amount the skilled artisan desires.

Referring to FIGS. 6A and also 7A, a detail of the air header 216 assembly is shown. The air header assembly 216 of the invention may be made from sheet metal, stainless steel or other suitable material having an outer side 216A, a top 216B, and inner side 216C, an outwardly extending flange 216D and an inwardly extending flange 216E. The air header assembly 216 fits on the top of the back rail 232 of the table 200 in a snug, sealed manner as shown in FIG. 6A by any appropriate means known in the art. An inwardly extending portion of the rail 232A may be received between top 216B, side 216C and flange 216D to aid in making a substantially air tight connection between rail 232 and the air header assembly 216. The inner side 216C includes air vents 218 formed by slotted openings inside 216C.

The flange 216E forms a lip that supports one side of the food pans 203, which may have a corresponding lip or edge that rests upon flange 216E. In this manner, the inner wall 232B of rail 232, the flange 216D, side 216C and lip 216E of the air header assembly 216 and the food pan 203 form an air duct 224 in which chilled air from cooling unit 226 is directed, similar to flow path 124 shown in FIG. 4. The air header assembly 216 may include a rounded corner 250 to reduce air turbulence within the air flow path 224. The air vents 218 should be sized and spaced to ensure a uniform flow of low velocity chilled air into and across the tops of the food pans 203, as discussed above. For example, the air vents 218 may be 1/16 of an inch wide slots evenly spaced across the face of the air header assembly 216. Additionally, any slot configuration which supplies a sufficient quantity of low velocity chilled air may be used. A typical slot pattern for the air vents 218 may include a single group of four rows of slots about 24 inches long where the slot rows are staggered relative to one another. Each slot may be about 3 inches long with the slots separated from one another by about ½ of an inch.

With the air header assembly of the invention, no separate conduits or tubes are needed to direct chilled air from the cooling unit. The front rail 232 and back wall 219 may contain insulation to thermally isolate air header assembly 216.

Figure 13:
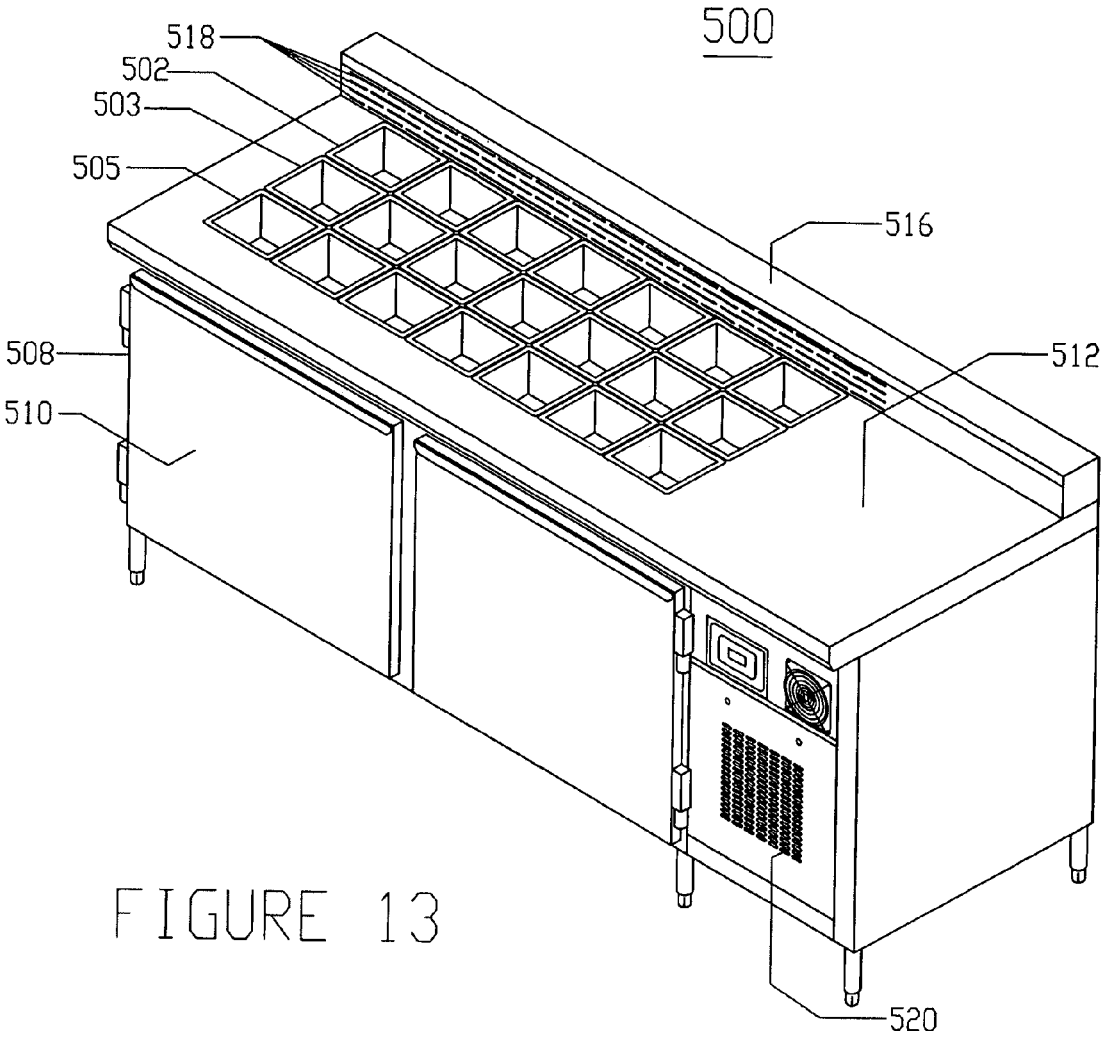
FIG. 13 is an elevated front perspective view of a fifth embodiment of an air blanketed food preparation constructed according to the principles of the invention containing three rows of food trays arranged in a single step configuration.

Referring to FIG. 6B, the detail of the section of the food preparation table 200 showing a drip rail 255 and drain 257 is explained. The drip rail 255 is located proximate a lower edge of the food pan 203 in a position configured to catch fluid which may drain or drip off the lower edge of the food pain 203 during, for example, a defrosting process. Attached to or formed in the drip rail 255 is a drain 257. The drain 257 is configured to carry fluid caught by the drain 257 for removal from the food preparation table 200. Defrosting is only necessary if the freon or refrigerant coils 252 shown in 6C are used to augment the performance of the air quilt to allow the rail with the embedded coils to form frost and help cool the product held in the food pans. This is especially useful if a 3-wide pan well arrangement like FIG. 13 is used.

Referring to FIG. 6C, the detail of a lower edge of the food pan 203 is shown. This side of food pan 203 rests on a flange portion 250A of a food preparation surface member 250, which may be made of sheet metal, stainless steel or similar material, and is attached to the table 200 over the back rail 254 in any appropriate manner known in the art. As shown best in FIGS. 6, 6C and also 7B, the food preparation surface member, which may form the top surface of any of the illustrated embodiments, includes flange 250A, an inner side 250B, top 250C, outer side 250D, flat working surface 250E and overhanging flange portions 250F, and 250G. The back rail 254 may be a cold rail that includes cooling coils 252 and/or appropriate insulation. The cooling coils 252 within rail 254 may be disposed above and below a top of the food pan 203. Alternatively, the cooling coils 252 may be provided only above or only below the top of the food pan 203. The cooling coils 252 are optional for adding further cooling protection for the contents of the food pan 203, and may be particularly advantageous in embodiments in which multiple rows of food pans are employed in the table.

Figure 8:
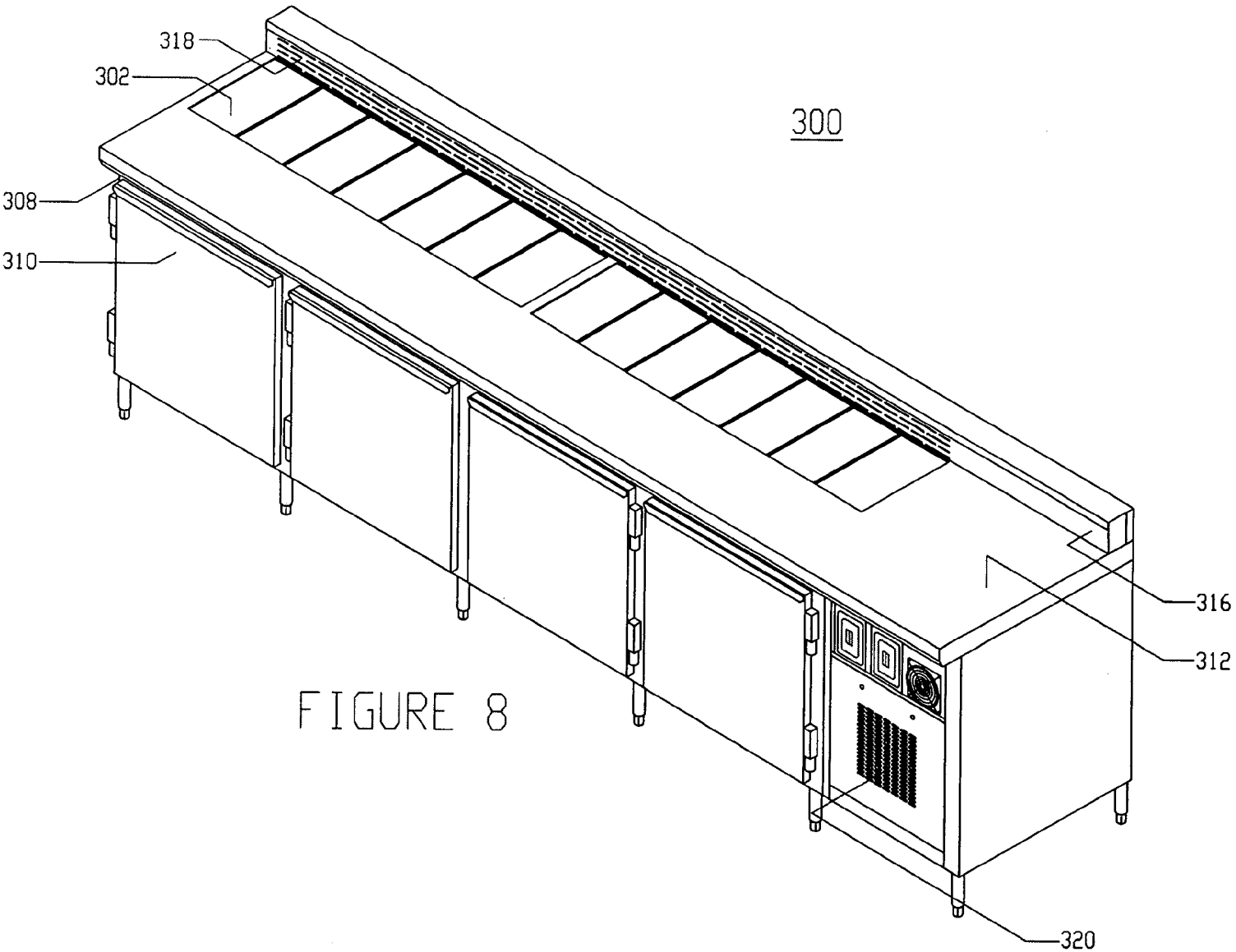
FIG. 8 is a front view of a third embodiment of an air blanketed food preparation table constructed according to the principles of the invention in which 14 food trays are arranged in a single step, single row configuration.

Referring to FIG. 8, a third embodiment of a food preparation table 300 of the invention having a single row of food pans arranged in a single step configuration is shown. Features or components similar to the previously described embodiments may not be discussed in detail herein. The food preparation table 300 has a cabinet 308, which has a front surface 310 and a top surface 312. The cabinet 308 includes a cooling housing 320 for housing a compressor or similar unit for cooling the table. Disposed within the top surface 312 of the food preparation table 300 are 14 food pan wells 302 provided in two groups of seven pans. The 14 food pan wells 302 are configured to hold food pans therein and are arranged in a row near the back of the top surface 312. Next to the food pan wells 302 is air header assembly 316 provided in a raised rail. The air header assembly 316 has a series of air vents 318 therein. The air vents 318 are positioned to direct chilled air from the interior of the table over and into food pans positioned in the food pan wells 302.

Figure 9:
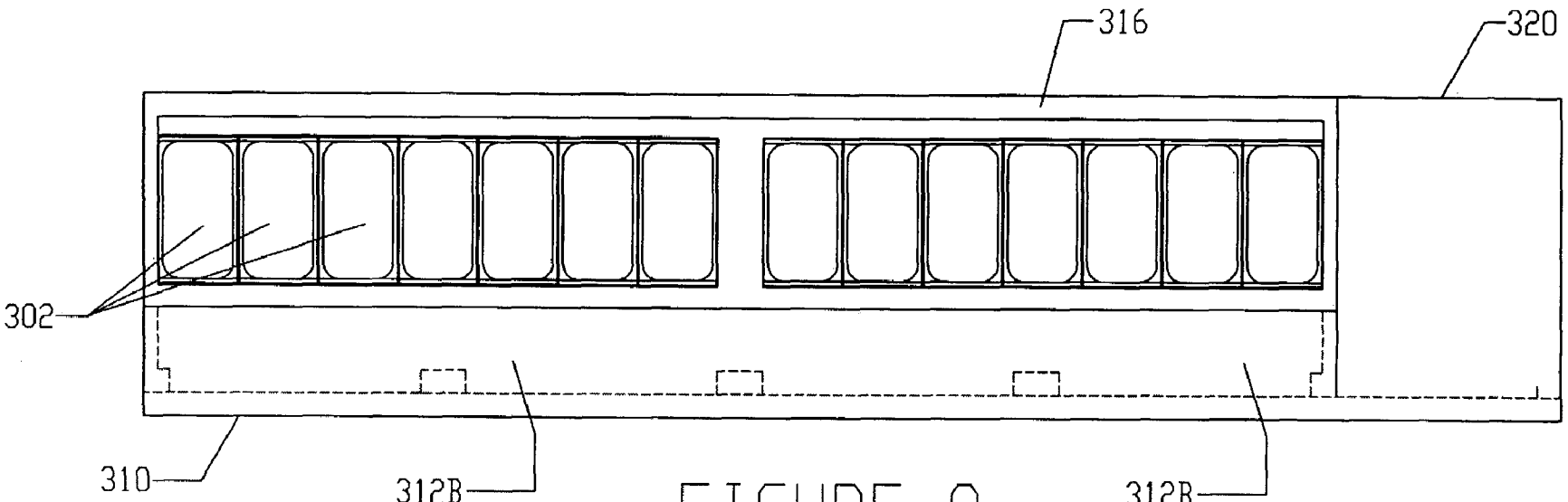
FIG. 9 is a top view of the table of FIG. 8.

Referring to FIG. 9, a top view of the food preparation table 300 is shown. FIG. 9 shows the housing 320 located at an end of the food preparation table 300. The condensing unit is housed in this enclosure, but four RAMK 13 coils may be used to refrigerate and generate the air curtain over the full length of the food pan well 302. A rear raised portion of the top surface 312 of the food preparation table 300 known as a rail includes the air header assembly 316. Also disposed along a front portion of the food preparation 300 adjacent the 14 food pans wells 302 is a food preparation surface 312B.

Figure 10:
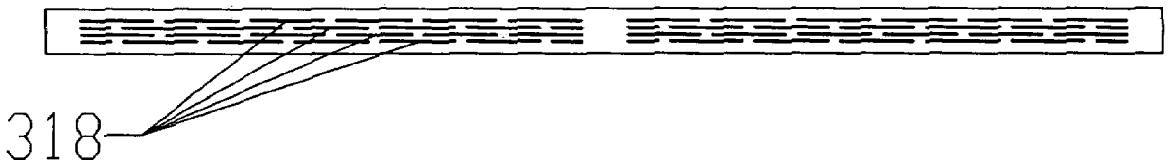
FIG. 10 is a front view of the air slot header assembly used in the table of FIG. 8.

Referring to FIG. 10, the front surface of the air header assembly 316 having the air vents 318 is shown. The air vents 318 may consist of slots formed in the air header assembly 316 where the slots are staggered relative to one another. The air vents 318 may be divided into two groups where each group consists of four rows of slots for directing chilled air into the two groups of pans running along the back side of the wells 302. In this embodiment, a typical group of slots 318 may be about 22 inches long where each individual slot is about 3¼ of an inch long. There may be about a ½ of an inch gap between the end of adjacent slots in a group and about a 1½ inch space at the beginning and end of the slot pattern. A slot may be about 1/16 of an inch wide, but slot widths may range from less than 1/32 of an inch to over ½ an inch in width.

Figure 11:
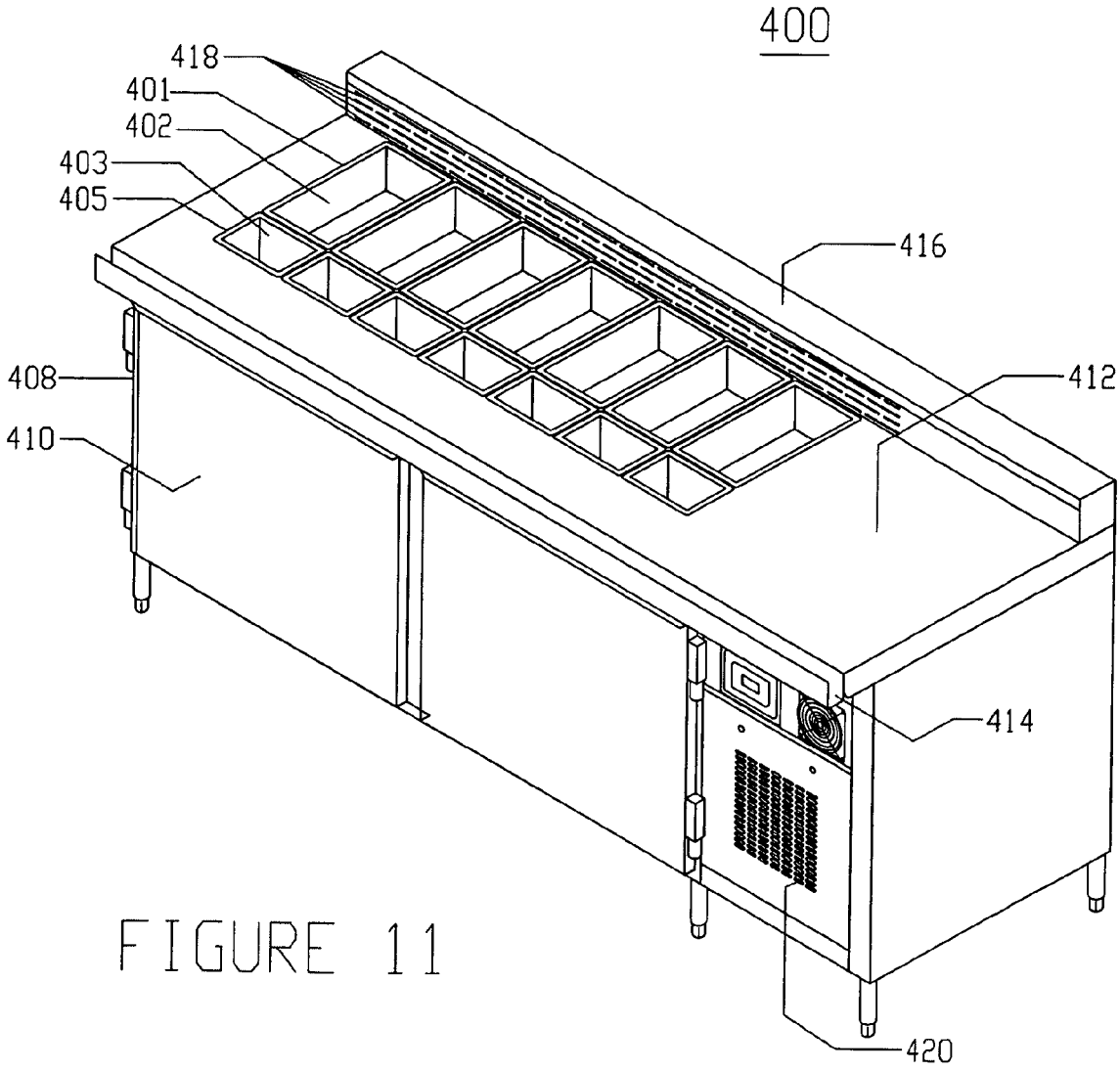
FIG. 11 is an elevated front perspective view of a fourth embodiment of an air blanketed food preparation table constructed according to the principles of the invention containing two rows of food trays arranged in a single step configuration.
Figure 12:
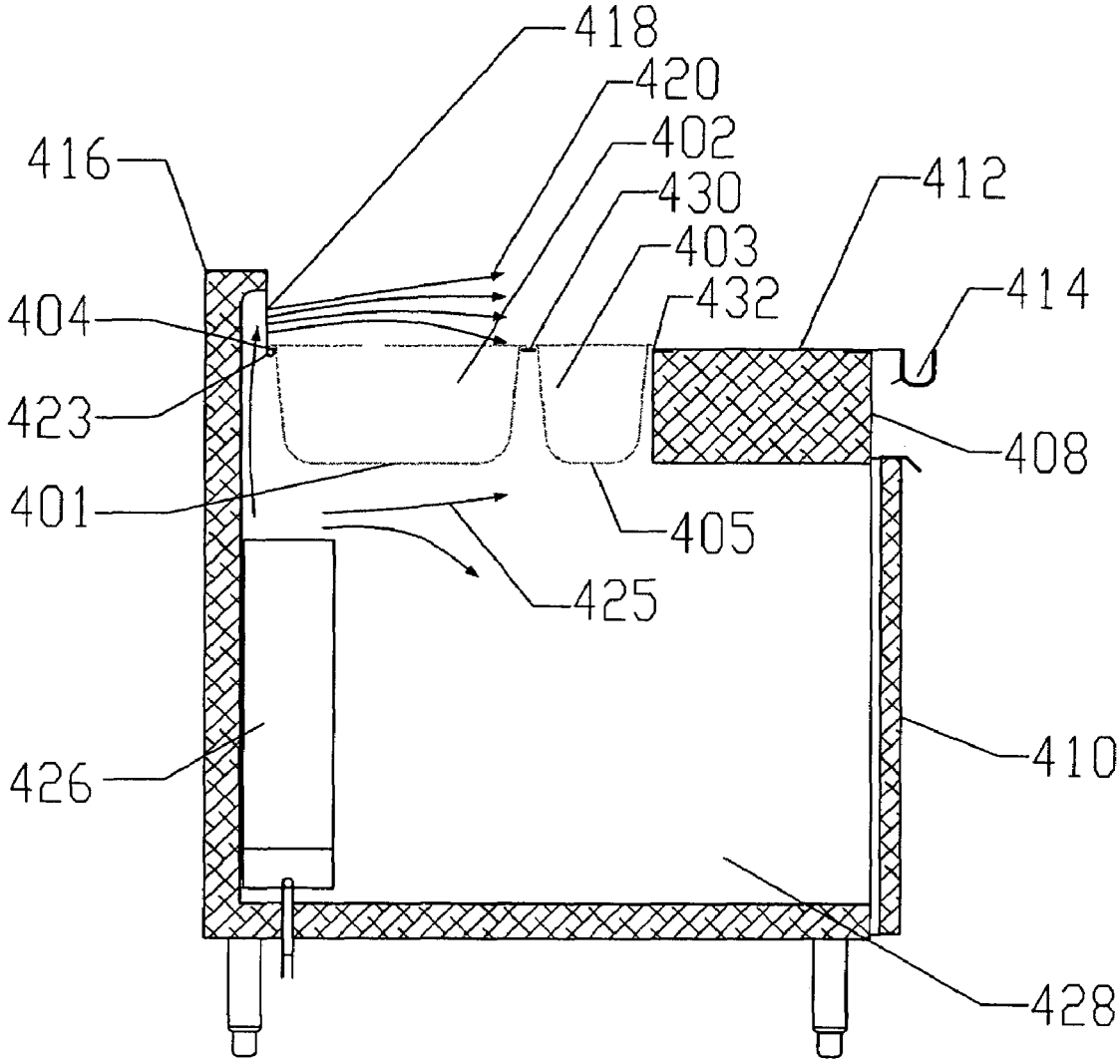
FIG. 12 is a cross sectional view of the table of FIG. 11.

Referring to FIGS. 11 and 12, a fourth embodiment of a food preparation table 400 of the invention having two rows of food pans arranged in a single step configuration is shown. Again, features or components similar to prior embodiments may not be described in detail. Referring to FIG. 11, the food preparation table 400 includes a cabinet 408 having a housing 420 for a compressor or similar unit. The food preparation table 400 has a top surface 412 with a series of openings 401 and 405 for a first row of food pans 402 and a second row of food pans 403. Adjacent to the first row of food pans 402 is air header assembly 416 providing a raised rail with air vents 418 therein. The food preparation table 400 has a front surface 410 which may have doors therein for access into an interior of the food preparation table 400.

As shown in FIG. 12, a cross section of the food preparation table 400 shows a first row of food pans 402 next to air vents 418 of air header assembly 416, and a second row of food pans 403 next to the first row food pans 402. The food pans of the first and second row of food pans 402 and 403 are positioned in food wells 401 and 405, respectively. Also shown in FIG. 12 is an interior 428 of the food preparation table 400, which includes an air cooling unit 426. The air cooling unit 426 provides chilled air which travels along various paths within the interior 428 of the food preparation table 400. For example, a first air path 424 travels through an interior of the air duct formed by the space between the air header assembly 416, the inner wall of interior 428, and the food pans 402, such that chilled air exits at a low velocity from air vents 418. A second air flow path 425 includes air circulating near the exterior surfaces of the food pans 402 and 403 within the interior 428 of the food preparation table 400 to indirectly cool the food pans. The flow paths may be created by adjustable baffles as discussed above.

Accordingly, chilled air can flow at a low velocity from the air vents 418 from cooling unit 426 to slowly flow into and across the tops of food pans in the first row of food pans 402 and the second row of food pans 403, thereby forming an air blanket in the pans and/or a barrier of cold air over the tops of the pans. As such, the two rows of foods pans 402 and 403 may receive protection against ambient room air by a blanket of cold air formed within and/or over each row of food pans by cold air exiting the air vents 418 at a low velocity. It should be noted that the size of the first row of food pans 402 may be different from the size of the second row of food pans 403. For example, the second row of food pans 403 may be smaller to accommodate being a farther distance from the air vents 418.

FIG. 12 also shows how the two rows of food pans are supported by first lip 404, a second lip 430, and a third lip 432 of the table 400. The first lip 404 may be formed by a flange of the air header assembly 416, similar to previously described embodiments, for supporting one side of the first row of food pans 402 next to the air vents 418. The second lip 430 may be part of a top surface of table 400 for supporting the other side of the first row of food pans 402 and one side of the second row of food pans 403. Thus, second lip 430 is located between the first and second row of food pans 402 and 403. The third lip 432 supports the other side of the second row of food pans 403, which is located farthest from the air vents 418. Additionally, the first lip 404 may optionally include a cooling tube 423 configured to circulate refrigerant therethrough to aid in further chilling the contents of the rows of food pans 402 and 403. For example, the tube 404 may be a glycol tube or other cooling structure known in the art. A thermistor or other temperature probe may be inserted in the cooling tube or other cooling structure to provide an indication of actual food temperature. As also shown in FIG. 12, the top surface 412 of food preparation table 400 may optionally include a removable crumb tray 414. The removable crumb tray 414 is configured to catch food crumbs which fall from the top surface 412 of the food preparation table 400.

Figure 14:
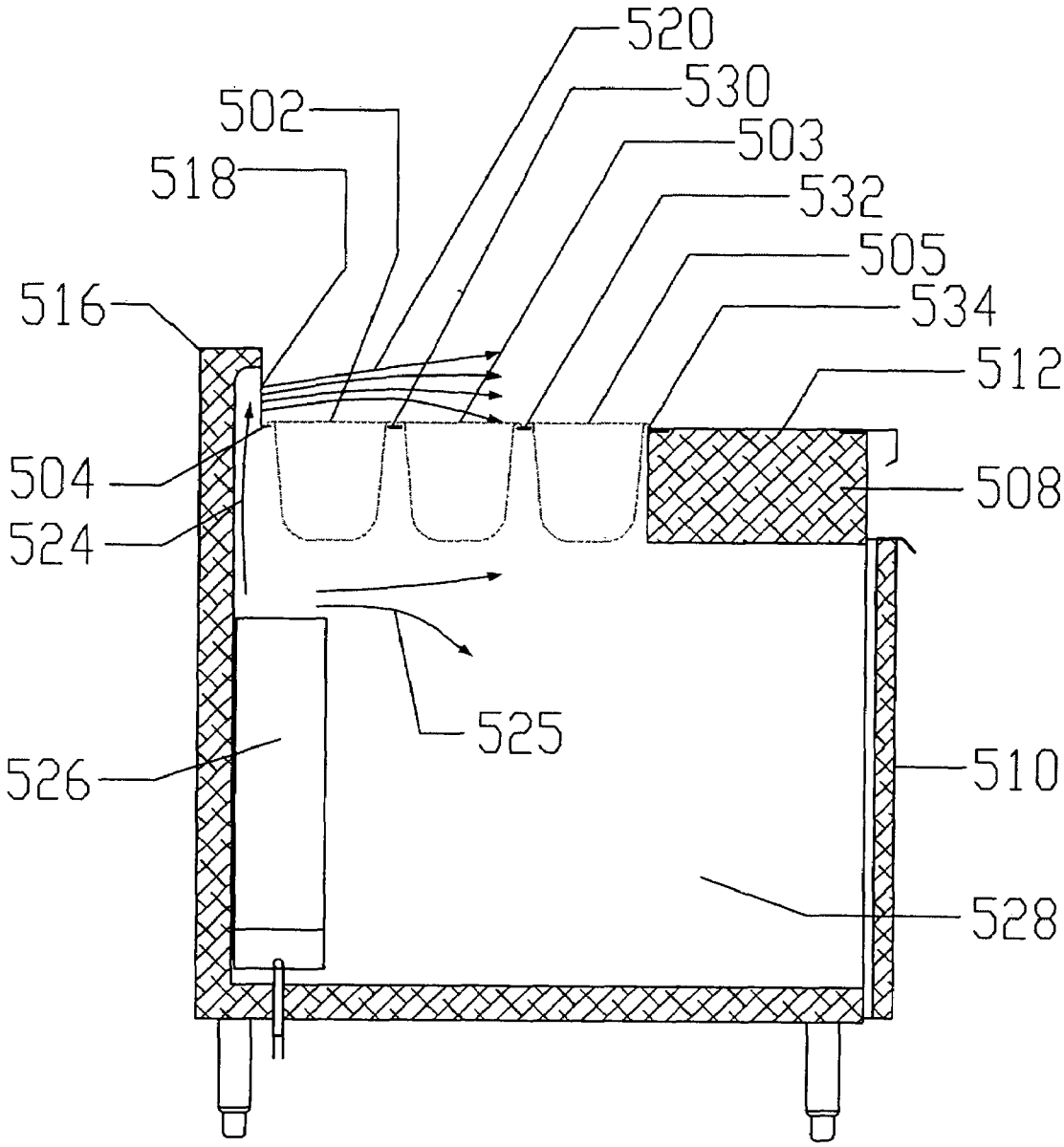
FIG. 14 is a cross sectional view of the table of FIG. 13.

FIGS. 13 and 14 show a fifth embodiment of a food preparation table 500 constructed according to the principles of the invention having three rows of food pans arranged in a single step configuration. As shown in FIG. 13, the food preparation table 500 has a cabinet 508 with a cooling unit housing 520. The cabinet 508 has a front 510 and a top surface 512. At a rear portion of the top surface 512 is a raised rail having an air header assembly 516 with air vents 518 therein. Disposed in the top surface 512 of the food preparation table 500 is a first row 502, a second row 503, and a third row 505 of food pans. The first row of food pans 502 is arranged next to the air header assembly 516 and vents 518. The second row of food pans 503 is between the first row of food pans 502 and the third row of food pans 505. Accordingly, the first row, second row, and third row of food pans 502, 503 and 505 are arranged so that each row may sequentially receive low velocity chilled air discharged from the air vents 518. As such, chilled air from the air vents 518 may pass at a low velocity from the vents 518 to flow into and across the top of the first row, second row and third row of food pans 502, 503 and 505.

Referring to FIG. 14, a cross section of the food preparation table 500 shows lips 504, 530 and 534 of the air header assembly 516 and the top surface of the table 500 supporting the rows of food pans 502, 503, and 505. Like the other embodiments, the interior 528 of the cabinet 508 has a cooling unit 526, which provides chilled air along multiple air paths. For example, chilled air flows from the cooling unit 526 along a first air flow path 524 into the duct formed by air header assembly 516 to exit at a low velocity from the air vents 518. Additionally, a second air flow path 525 circulates within the interior 528 of the cabinet 508 to cool the food pans 502, 503 and 505 from an exterior of each food pan. Although three rows of food pans 502, 503 and 505 are shown, any number of rows of food pans which receive a sufficient quantity of cool air to keep the contents of the food pans properly chilled may be used. Additionally, incorporating a cold recessed face similar to that described in FIG. 6 enables a single air quilt layer of air to be efficiently deployed over a distance of up to about 23" from the slot face. Testing has shown a discharge stream of air from a single row of vents to be effective for distances up to at least 15" away from the row of vents for food pans which are level with a top surface of the make-table.

Figure 16:
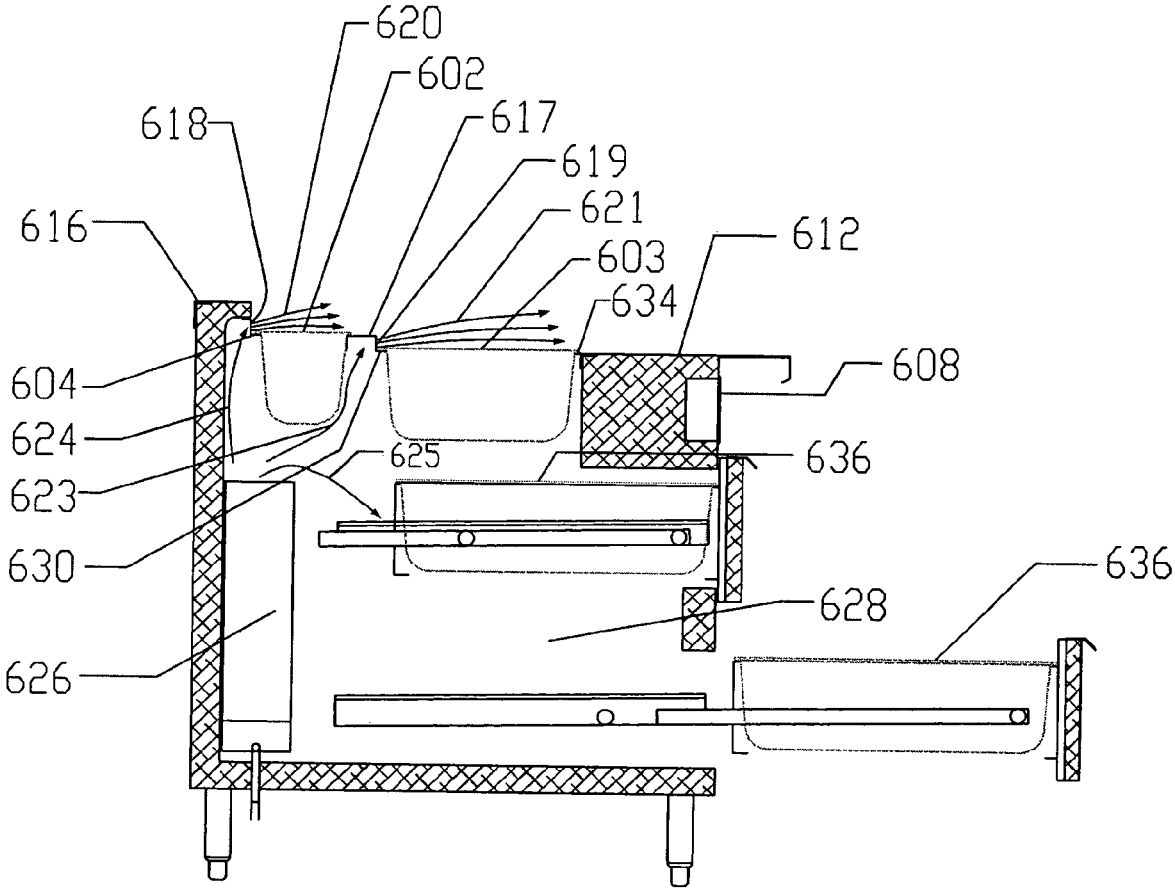
FIG. 16 is a cross sectional view of the table of FIG. 15.

Referring to FIGS. 15 and 16, a sixth embodiment of a food preparation table 600 of the invention is shown in which two rows of food pans are arranged in a double step configuration. The food preparation table 600 includes a cabinet 608 having a front surface 610 and a first top surface 612 and a second top surface 613. A portion of the cabinet 608 has a cooling unit housing 620. The first top surface 612 is adjacent the front 610, and the second top surface 613 is adjacent a rear rail which includes a first air header assembly 616. The surfaces 612, 613 are tiered or stepped relative to one another such that the second top surface 613 is at a level higher than the first top surface 612. First air header assembly 616 is disposed near the rear of the second top surface 613, while a second air header assembly 617 is provided intermediate the two rows of food pans 602 and 603. Air header assemblies 616, 617 may be constructed in a similar manner as the previously described embodiments, and each includes slots forming air vents 618, 619 respectively.

The first row of food pans 603 is located next to the first set of air vents 619. The second air header assembly 617, forms a second air duct in the space between the first row of food pans 603 and the second row of food pans 602, as shown best in FIG. 16. As such, the first air vents 619 are configured to discharge cooled air at a low velocity into and over the food pans 603. The second row of food pans 603 is located next to the second set of air vents 618. Accordingly, the second air vents 616 are configured to discharge chilled air at a low velocity into and above the food pans 602, and possibly into and over food pans 603. Thus, air vents 619 provide a layer of low velocity cold air to protect the contents of food pans 603, and the air vents 618 provide low velocity cooled air to protect at least the contents of food pans 602.

FIG. 16 shows an interior 628 of the food preparation table 600 having a cooling unit 626 similar to the prior embodiments. The cooling unit 626 directs air along multiple air paths within the interior 628 of the food preparation table 600. For example, the cooling unit 626 directs air along a first air flow path 624 to air vents 618, and directs air along a second air flow path 623 to the air vents 619. Additionally, the cooling unit 626 can direct air along a third air flow path 625 to circulate within a different section of the interior 628 of the food preparation table 600. In particular, the food preparation table 600 may have one or more food drawers 636 slidably disposed in the cabinet 608. Accordingly, contents of the food drawers 636 may be cooled by air coming from the cooling unit 626 along third flow path 625. Other embodiments of the food preparation table may have other types of food storage systems within the interior, such as shelves, etc.

Figure 17:
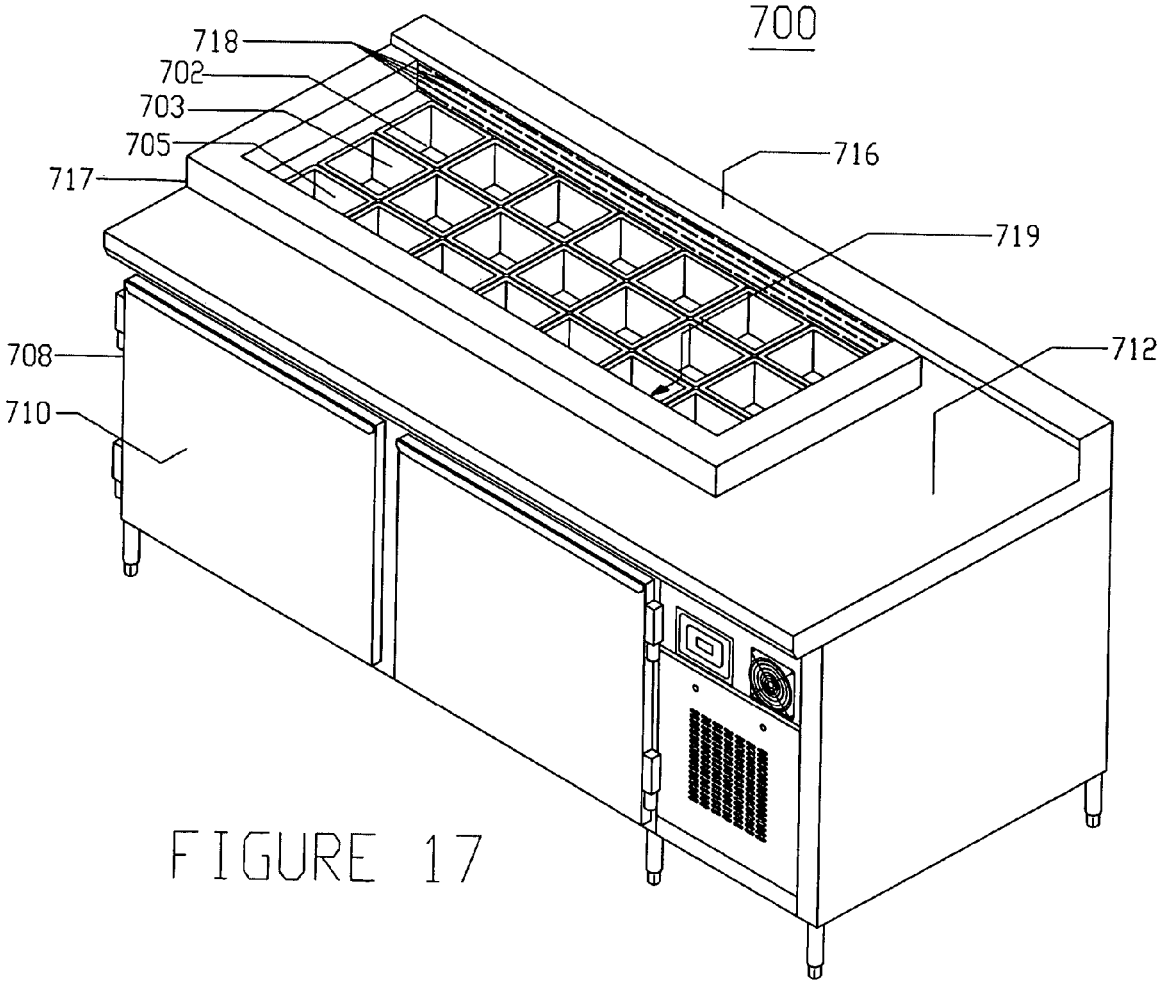
FIG. 17 is an elevated front perspective of a seventh embodiment of an air blanketed food preparation table constructed according to the principles of the invention in which three rows of food trays receive low velocity chilled air from two opposed directions.
Figure 18:
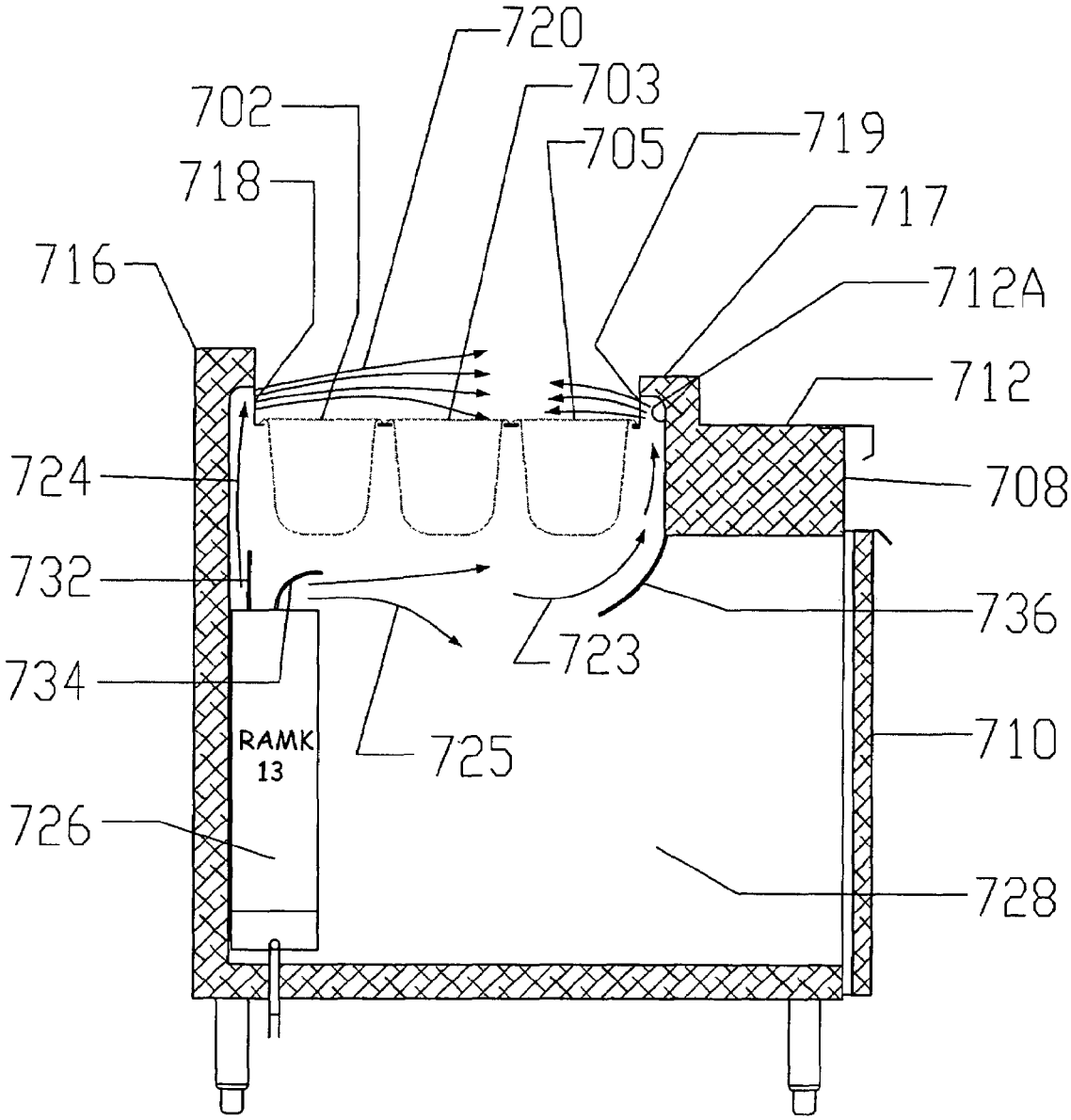
FIG. 18 is a cross sectional view of the table of FIG. 17.

FIGS. 17–18 show a seventh embodiment of the food preparation table 700 of the invention in which three rows of food pans receive low velocity, chilled air from opposite directions. The food preparation table 700 has a cabinet 708 with a front surface 710 and a top surface 712. Along the rear of the top surface 712 is a rear raised rail having a rear air header assembly 716 with air vents 718 therein. Toward the middle of the top surface 712 is a front, raised rail having a front air header assembly 717 with slots therein forming air vents 719. Disposed within the top surface 712 and between the air header assemblies 716, 717 are three rows of food pans 702, 703 and 705. Although three rows of food pans are shown, any number of rows of food pans may be utilized which receive sufficient cooling air from either or both the opposed air vents 719 and 718.

As best seen in FIG. 18, the front air vents 719 direct low velocity chilled air 721 into and over the third, second and first rows of food pans 705, 703 and 702 respectively. The rear air vents 718 direct low velocity chilled air 720 into and over the tops of the first, second and third rows of food pans 702, 703, and 705, respectively. As such, the food pans positioned between the air header assemblies 717 and 716 may receive low velocity chilled air from either opposing duct. Consequently, a greater number of rows of food pans may be arranged next to one another with all the food pans receiving sufficient amounts of low velocity chilled air to protect the contents of the food pans.

Referring again to FIG. 18, the cooling unit 726 produces chilled air which, like the prior embodiments, may be guided along various air flow paths within the interior 728 of the cabinet 708 by a series of adjustable baffles. In particular, a first baffle 732 on top of cooling unit 726 directs chilled air along a first air path 724 into the rear air duct 716. A second baffle 734 on top of cooling unit 726 directs chilled air along a second air flow path 723, which may also include a third fixed baffle 736 supported in the interior 728 for assisting in directing chilled air along the second air flow path 723 into the front air duct formed by the front air header 717 and the space between one side of food pan 705 and an interior wall 712A. Additionally, the second baffle 734 may direct air along a third air flow path 725 to circulate chilled air within the interior 728 of the food preparation table 700.

Figure 19:
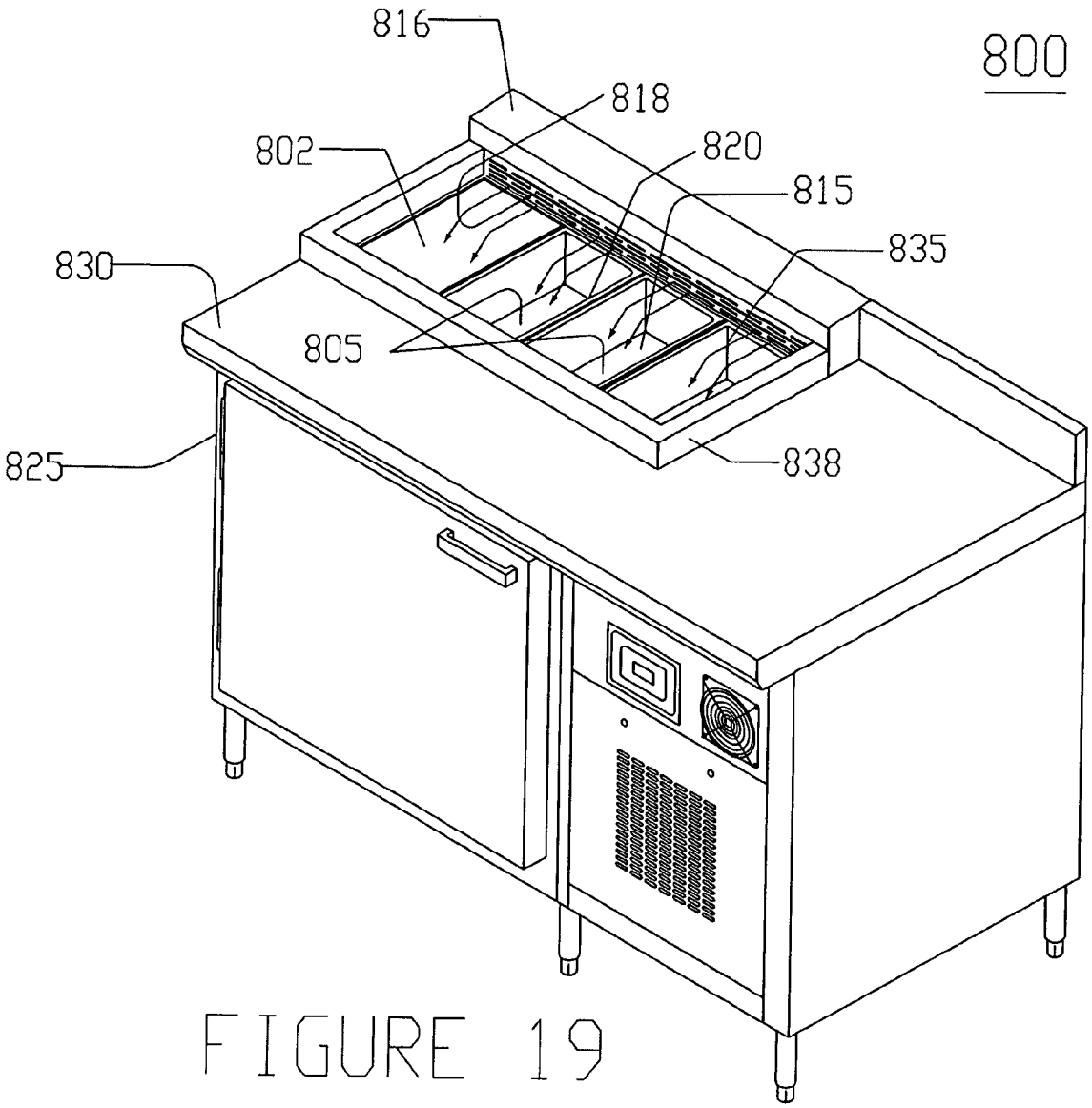
FIG. 19 is an elevated front perspective view of an eighth embodiment of an air blanketed food preparation table constructed according to the principles of the invention in which the food trays are surrounded by walls to help contain the chilled air blanket.

FIG. 19 is an elevated front perspective view of an eighth embodiment of a food preparation table 800 of the invention in which the food preparation table 800 has food pans 805 arranged in pan wells 802 surrounded by a wall 838. A similar arrangement was also shown in FIG. 6. The wall 838 forms a raised boundary around three sides of the food pans 805 to help contain chilled air therein. The fourth side of the pans is adjacent a raised rail in which an air header assembly 816 have slotted air vents 818 similar to the prior embodiments is provided. The pan wells 802 are openings in a top surface 830 of the food preparation table 800. The food pans 805 have lips or rims 820, which rest on a top surface 830 of the food preparation table 800 thereby supporting the food pans 805. Chilled air from a cooling system inside the table is directed from the air vents 818 at a low velocity and follow air flow paths 835 to flow into the interior 815 of the food pans 805. After air has passed into the interior 815 of the food pans 805, the air may build up and flow out of the food pans 805 and over the wall 838 and across the top surface 830 of the food preparation table 800.

Various specific implementations and examples of food preparation tables made in accordance with the principles of the invention have been successfully made. For example, in the air header assemblies of the invention it has been found that sets of 3 to 5 straight ¼" intermittent or staggered (for structural integrity) non-louvered slots with ¼ to ½" centers delivering chilled air at a face velocity between about 8 ft/min and about 75 ft/min at a distance between 1 and 2" above the food pans may result in an insulating layer or blanket of cooler dry air (20° F. or greater differential when compared to the ambient kitchen temperatures). This aids in enabling the food pans to be stored uncovered in open wells or rails without falling outside established refrigerated bulk food holding temperature (35° F. to 41° F.) and compromising the food shelf life and quality without requiring excessive mechanical complexity and/or field system calibration.

The protective boundary layer of chilled air may extend up to about 15" away from the vents for flush or recessed wells when only one set of slots are used which will protect a narrower length of conventional 12"×20" series (Gastronorm) food service storage pans. Opposing slots from each end of the well will allow this design to protect at least a full 20" pan depth. Two vertically offset wells or rails may also be fabricated with only rear slotted air discharge patterns and still blanket the tops of food storage pans if the two wells are sized to accommodate one row of $\frac{1}{6}^{th}$ or ¼ pans (6.4" depth) and the other sized to accept ⅓, ½ or full size pans (12.8" depth). In either case, two sets of slots will blanket at least the full 12×20 pan series conventional opening depth with cool air.

The slot pattern and conventional top discharge fan coil evaporator design enables this protective air blanket to be effective for longer rails (for example, 20 to 26" centers) which enables one conventional 15" evaporator to cool or regulate a full 2 pan depth and the pattern may be repeated as long as commercially viable for fabrication. The well designs may be extendable to 11" lengths in either self-contained or remote models.

Using a simple series of open fixed and/or adjustable baffles, as described herein, enables the evaporator air stream discharge to be divided into a series of streams to provide the air needed for the open slots comprising the open well cold air blanket. Additionally, air cooling the bottom of the open well food pans to enhance the performance of the open well air blanket may be included. Such additional cooling may provide sufficient air currents and cooling to enable the base to store additional food product in the interior accessed by doors or drawers with only one thermostatic controller to regulate the flow of refrigerant to the coil. Air velocity may be controlled by adjustable baffles, and may also be controlled by a variable speed fan.

Lab testing has shown that for a twin well (dual row) system, three distinct different holding temperatures may be achieved using this technology i.e. cold rail holding temperatures of about 36° F. and about 40° F. with a cabinet temperature of about 38° F. due to the wind chill cooling effect of air movement over the pan bottoms and the insulating impact delivered by the gentle air blanket over the open pans. The design is cost effective as a single evaporator may be adapted to allow independent regulation for the base and one or two open rails with minimal loss to the surrounding environment due to the low volume of air dissipated to the surrounding environment. It may be preferable that the cooling coil be oversized by 20 to 33% to accommodate fouling and losses that might occur over time. 10% oversizing of the coil has been sufficient to make the air blanket effective under laboratory conditions.

The invention obviates the need for separate ducting and expensive internal fabrication to control or direct the air flow. The simple contoured baffle network of the invention provide sufficient air flow control once the air flow patterns for each are well established in the laboratory. The baffles may be adjusted or fixed for each of the selected standard well or rail configurations. To ensure consistent results are achieved, it is recommended that the production baffles be pinned or welded in place after an optimum position is found such that normal use will not displace them. Adjustable baffles are appropriate in the lab or special applications to determine the correct baffle positioning.

Although the above descriptions are directed to various embodiments of the invention, other variations and modifications and may be made without departing from the spirit and scope of the invention. For example, the air vents for directing low velocity chilled air into the food pans may be integrated into a side of the food pan itself, rather than in a separate air header assembly. Similarly, the air header system of the invention could be retrofitted by means of a top cover or counter top extension containing the desired cool air stream slotted pattern if an air blanket system were desired to be added to an existing make-table such that it would meet Model Food Code requirements. Moreover, features described in connection with one embodiment of the invention may be used in conjunction with other embodiments, even if not explicitly stated above.

What is claimed is:

1. A refrigerated make-table, comprising:

at least one food pan having an opening in fluid communication with an interior space in the food pan;

an air duct in fluid communication with the opening in said at least one food pan;

a cooling system including a chilled air source arranged to conduct chilled air over the opening of said at least one food pan via said air duct at a velocity of between approximately 8 feet per minute and approximately 75 feet per minute to form an air blanket isolating said at least one food pan from ambient air and maintaining the interior of said at least one food pan at a temperature range between approximately 35° F. and approximately 41° F.

2. The refrigerated make-table of claim 1, wherein said air blanket remains within the interior space of said at least one food pan.

3. The refrigerated make-table of claim 1, wherein said air blanket forms a barrier of low velocity chilled air moving over the opening of said at least one food pan, said barrier hindering warmer ambient air from entering into said opening.

4. The refrigerated make-table of claim 1, wherein said opening in said at least one food pan comprises an opening in a top portion of said at least one food pan.

5. The refrigerated make-table of claim 1, wherein said chilled air source includes at least one evaporative refrigeration coil and a fan directing chilled air from and around said coil into said air duct.

6. The refrigerated make table of claim 1, wherein said cooling system is disposed within the make-table.

7. The refrigerated make-table of claim 1, further comprising an adjustable control element configured to divide the chilled air from said source into a plurality of streams, one of said streams being conducted to directly cool said at least one food fan and another of said streams being conducted into said air duct.

8. The refrigerated make-table of claim 1, wherein said adjustable control element comprises a plurality of baffles, at least one of which may be fixed in any number of positions.

9. The refrigerated make-table of claim 1, further comprising a control element controlling the direction of chilled air conducted from said air duct to said at least one food pan.

10. The refrigerated make-table of claim 9, wherein said control element comprises an air header assembly having a plurality of apertures.

11. The refrigerated make-table of claim 10, wherein said apertures are arranged in staggered rows.

12. The refrigerated make-table of claim 1, wherein said air duct comprises space between said at least one food pan and an internal wall of the make-table.

13. The refrigerated make-table of claim 1, wherein said air duct is formed without any conduits isolated from the interior of the make-table.

14. The refrigerated make-table of claim 1, further comprising a cooling device located adjacent said at least one food pan.

15. The refrigerated make-table of claim 1, wherein said make-table includes a first raised rail and said air duct is located at least partially in said first rail.

16. The refrigerated make-table of claim 15, further comprising a second raised rail including an auxiliary cooling system for cooling said at least one food pan, said first and second raised rails being disposed at opposite edges of said at least food pan.

17. The refrigerated make-table of claim 15, further comprising a separate cooling device disposed adjacent said air duct.

18. The refrigerated make-table of claim 1, wherein said at least one food pan is mounted in the make-table at an angle relative to a horizontal reference line.

19. The refrigerated make-table of claim 1, wherein said at least one food pan comprises multiple rows of food pans disposed to receive chilled air from said air duct, each row having at least one food pan.

20. The refrigerated make-table of claim 19, wherein at least one row of said multiple rows of food pans is positioned at a different level than another row of said multiple rows of food pans.

21. The refrigerated make-table of claim 1, wherein said air duct comprises a first and a second spaced air duct, each air duct conducting low velocity chilled air into at least one row of said multiple rows of food pans.

22. The refrigerated make-table of claim 21, wherein said second air duct directs chilled air at low velocity in a direction substantially opposite to the direction air emanates from said first air duct.

23. The refrigerated make-table of claim 21, wherein said first and second air ducts have vents facing in substantially similar directions.

24. The refrigerated make-table of claim 21, wherein said second air duct comprises a vent at a different height relative to a vent in said first air duct.

25. The refrigerated make-table of claim 1, further comprising a raised barrier disposed substantially surrounding said at least one food pan to help isolate low velocity chilled air directed thereto from ambient air.

26. A method of operating a make-table, said method comprising the steps of:

placing food in a food pan;

placing the food pan at least partially within a food pan well in the make-table;

directing chilled air over the food pan; and controlling the velocity of the chilled air between approximately 8 feet per minute and approximately 75 feet per minute to permit the chilled air to create a protective boundary layer of chilled air disposed above the food in the food pan, thereby providing an air blanket insulating the food pan from ambient air and maintaining an interior temperature of the food pan at a temperature of about 35° F. to about 41° F.

27. The method of claim 26, wherein the air blanket created by said velocity controlling step remains within the food pan.

28. The method of claim 26, wherein the air blanket created by said velocity controlling step forms a barrier comprising low velocity chilled air moving over the food pan to isolate the food pan from warmer, ambient air.

29. The method of claim 26, further comprising cooling the exterior of the food pan.

30. The method of claim 29, wherein the step of directing chilled air to the food pan comprises dividing the chilled air into a series of streams, one of the streams being directed to the interior of the food pan and the other to the exterior of the food pan.

31. The method of claim 30, further comprising adjustably controlling the direction of at least one of the chilled air streams.

32. The method of claim 30, wherein the food pan comprises at least two rows of food pans and further comprising dividing the chilled air into at least three streams, with a first one of the streams being directed into a first food pan, a second one of the streams being directed into a second food pan, and a third one of the streams being directed towards the exterior of at least one of the first and second food pans.

33. The method of claim 26, wherein the food pan comprises at least two rows of food pans and further comprising dividing the chilled air into two low velocity streams generally directed towards each other.

34. The method of claim 26, wherein the food pan comprises at least two rows of food pans and further comprising dividing the chilled air into two low velocity streams generally directed in substantially similar directions.

35. A refrigerated make-table, comprising:

means for containing food;

means for supporting said food containing means; and means for conducting chilled air at a velocity of between approximately 8 feet per minute to approximately 75 feet per minute over said containing means.

36. The refrigerated make-table of claim 35, wherein said chilled air conducted over said food containing means forms a barrier of hindering warmer ambient air from entering said containing means.

* * * * *